US009274442B2

(12) United States Patent
Sato et al.

(10) Patent No.: US 9,274,442 B2
(45) Date of Patent: Mar. 1, 2016

(54) ELECTROPHOTOGRAPHIC IMAGE FORMING APPARATUS HAVING CHARGE TRANSPORT LAYER WITH MATRIX-DOMAIN STRUCTURE AND CHARGING MEMBER HAVING CONCAVITY AND PROTRUSION

(71) Applicant: CANON KABUSHIKI KAISHA, Tokyo (JP)

(72) Inventors: Taichi Sato, Numazu (JP); Tomohito Taniguchi, Suntou-gun (JP); Noboru Miyagawa, Suntou-gun (JP); Takehiko Aoyama, Suntou-gun (JP); Atsushi Uematsu, Fuji (JP); Masahiro Watanabe, Mishima (JP); Yuki Yamamoto, Tokyo (JP); Harunobu Ogaki, Suntou-gun (JP); Akihiro Maruyama, Mishima (JP); Takashi Anezaki, Hiratsuka (JP); Daisuke Miura, Tokyo (JP); Hirofumi Kumoi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/662,228

(22) Filed: Mar. 18, 2015

(65) Prior Publication Data

US 2015/0277244 A1 Oct. 1, 2015

(30) Foreign Application Priority Data

Mar. 27, 2014 (JP) ..... 2014-066587

(51) Int. Cl.

| | |
|---|---|
| ***G03G 15/00*** | (2006.01) |
| ***G03G 5/04*** | (2006.01) |
| ***G03G 15/02*** | (2006.01) |

(52) U.S. Cl.
CPC ..... *G03G 5/04* (2013.01); *G03G 15/0233* (2013.01)

(58) Field of Classification Search
CPC . G03G 5/04; G03G 15/0233; G03G 21/1814; G03G 21/0005
See application file for complete search history.

(56) References Cited

U.S. PATENT DOCUMENTS

| | | | |
|---|---|---|---|
| 5,455,135 | A | 10/1995 | Maruyama et al. |
| 6,416,915 | B1 | 7/2002 | Kikuchi et al. |

(Continued)

FOREIGN PATENT DOCUMENTS

| | | | |
|---|---|---|---|
| JP | 7-13368 | A | 1/1995 |
| JP | 2007-79555 | A | 3/2007 |

(Continued)

OTHER PUBLICATIONS

U.S. Appl. No. 14/656,574, filed Mar. 12, 2015. Inventor: Akihiro Maruyama, et al.

*Primary Examiner* — Francis Gray
(74) *Attorney, Agent, or Firm* — Fitzpatrick, Cella, Harper and Scinto

(57) ABSTRACT

Provided an electrophotographic image forming apparatus comprising an electrophotographic photosensitive member and a charging member. The electrophotographic photosensitive member includes a charge transport layer as a surface layer having a matrix-domain structure including specific resins. The charging member comprises an electro-conductive substrate, and an electro-conductive elastic layer. The electro-conductive elastic layer comprises a binder, and holding a bowl-shaped resin particle having an opening, so that at least a part of the bowl-shaped resin particle is exposed, and the charging member has a concavity derived from the opening of the bowl-shaped resin particle on the surface thereof, and a protrusion derived from an edge of the opening of the bowl-shaped resin particle on the surface thereof.

14 Claims, 6 Drawing Sheets

(56) References Cited

U.S. PATENT DOCUMENTS

| | | | | |
|---|---|---|---|---|
| 7,556,901 | B2 | 7/2009 | Anezaki et al. | |
| 7,563,553 | B2 | 7/2009 | Kikuchi et al. | |
| 7,732,113 | B2 | 6/2010 | Nakamura et al. | |
| 7,875,410 | B2 * | 1/2011 | Ogaki | G03G 5/056 430/58.8 |
| 8,465,889 | B2 | 6/2013 | Sekido et al. | |
| 8,546,050 | B2 | 10/2013 | Maruyama et al. | |
| 8,795,936 | B2 | 8/2014 | Sekido et al. | |
| 2010/0092208 | A1 * | 4/2010 | Ogaki | G03G 5/056 399/111 |
| 2011/0305481 | A1 | 12/2011 | Taniguchi et al. | |
| 2013/0266338 | A1 * | 10/2013 | Taniguchi | G03G 15/0233 399/111 |
| 2014/0093815 | A1 * | 4/2014 | Yamamoto | G03G 5/0607 430/56 |
| 2014/0255838 | A1 * | 9/2014 | Matsuda | G03G 5/14708 430/56 |
| 2014/0301754 | A1 | 10/2014 | Uematsu et al. | |
| 2015/0003872 | A1 | 1/2015 | Taniguchi et al. | |

FOREIGN PATENT DOCUMENTS

| | | | |
|---|---|---|---|
| JP | 2012-42700 | A | 3/2012 |
| WO | 2010/008095 | A1 | 1/2010 |

* cited by examiner

ELECTROPHOTOGRAPHIC IMAGE FORMING APPARATUS HAVING CHARGE TRANSPORT LAYER WITH MATRIX-DOMAIN STRUCTURE AND CHARGING MEMBER HAVING CONCAVITY AND PROTRUSION

BACKGROUND OF THE INVENTION

1. Field of the Invention

The present invention relates to an electrophotographic image forming apparatus.

2. Description of the Related Art

An electrophotographic image forming apparatus is repeatedly subjected to each of the processes such as charging, exposure, developing, transferring and cleaning. The surface of an electrophotographic photosensitive member is required to have high lubricity to a member in contact with the surface of the electrophotographic photosensitive member, such as a cleaning blade for removal of transfer residual toner.

In order to solve the problem of lubricity, a method for adding silicone oil such as polydimethyl siloxane to the surface layer of an electrophotographic photosensitive member is proposed in Japanese Patent Application Laid-Open No. H07-13368.

On the other hand, a charging member in contact with the electrophotographic photosensitive member at a predetermined contact pressure and driven to rotate on a steady basis in an electrophotographic image forming apparatus is required to be stably driven to rotate on a steady basis even when the lubricity of the electrophotographic photosensitive member is increased.

A method for reducing the area substantially in contact with an electrophotographic photosensitive member by increasing the surface roughness of a charging member is proposed in Japanese Patent Application Laid-Open No. 2012-42700 from the viewpoint of preventing the electrophotographic photosensitive member from being shaved off.

However, the present inventors examined the electrophotographic photosensitive member and the charging member described in Japanese Patent Application Laid-Open No. H07-13368 and Japanese Patent Application Laid-Open No. 2012-42700, and found the following problems. Namely, the combination of an electrophotographic photosensitive member having lubricity and a charging member containing large-size particles in a coating layer easily caused micro slips between the electrophotographic photosensitive member and the charging member when the electrophotographic photosensitive member and the charging member in contact with each other were rotated. Consequently, an image defect, i.e. horizontal micro striped image (hereinafter referred to as "banding image"), occurred in the output image in some cases.

SUMMARY OF THE INVENTION

The present invention is directed to providing an electrophotographic image forming apparatus capable of outputting good images by preventing the occurrence of banding image due to slips caused when the electrophotographic photosensitive member and the charging member in contact with each other are rotated.

According to one aspect of the present invention, there is provided an electrophotographic image forming apparatus including: an electrophotographic photosensitive member, a charging unit in contact with the electrophotographic photosensitive member so as to charge the electrophotographic photosensitive member with a charging member, and a developing unit which supplies toner to the electrophotographic photosensitive member on which an electrostatic latent image is formed to form a toner image on the electrophotographic photosensitive member; wherein the electrophotographic photosensitive member includes: a support, a charge generation layer disposed on the support, and a charge transport layer disposed on the charge generation layer; the charge transport layer is a surface layer of the electrophotographic photosensitive member; the charge transport layer has a matrix-domain structure including a matrix and a domain; the domain includes a polyester resin A having a structural unit represented by the following Formula (A) and a structural unit represented by the following Formula (B); the matrix includes at least one resin selected from the group consisting of a polyester resin C having a structural unit represented by the following Formula (C) and a polycarbonate resin D having a structural unit represented by the following Formula (D) and a charge transport substance; the charging member has an electro-conductive substrate and an electro-conductive elastic layer; the electro-conductive elastic layer includes a binder and holds a bowl-shaped resin particle having an opening, so that at least a part of the bowl-shaped resin particle is exposed, and; the charging member has a concavity derived from the opening of the bowl-shaped resin particle on the surface thereof, and a protrusion derived from an edge of the opening of the bowl-shaped resin particle on the surface thereof; the protrusion on the surface of the charging member being the exposed part of the bowl-shaped resin particle; and the protrusion on the surface of the charging member coming into contact with the electrophotographic photosensitive member.

(A)

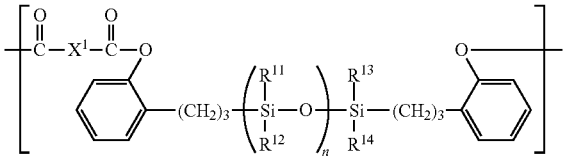

In Formula (A), $X^1$ represents a m-phenylene group, a p-phenylene group, or a bivalent group having two p-phenylene groups bonded to an oxygen atom, $R^{11}$ to $R^{14}$ each independently represent a methyl group, an ethyl group, or a phenyl group, n represents the number of repetitions of a structure in brackets, and the average value of n in the polyester resin A is 20 or more and 120 or less.

(B)

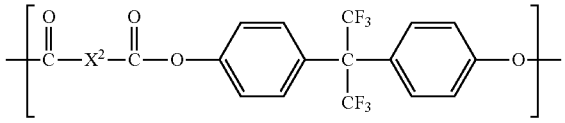

In Formula (B), $X^2$ represents a m-phenylene group, a p-phenylene group, or a bivalent group having two p-phenylene groups bonded to an oxygen atom.

(C)

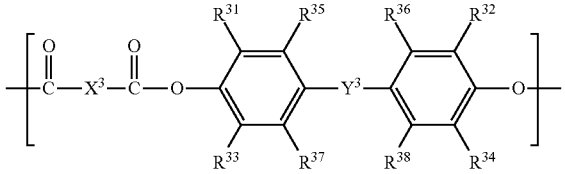

In Formula (C), $R^{31}$ to $R^{38}$ each independently represent a hydrogen atom, or a methyl group, $X^3$ represents a m-phenylene group, a p-phenylene group, or a bivalent group having two p-phenylene groups bonded to an oxygen atom, and $Y^3$ represents a single bond, a methylene group, an ethylidene group, or a propylidene group.

(D)

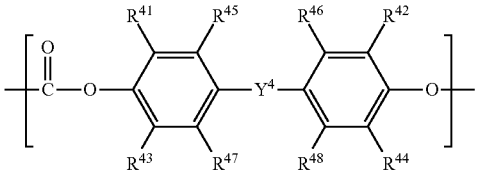

In Formula (D), $R^{41}$ to $R^{48}$ each independently represent a hydrogen atom, or a methyl group, and $Y^4$ represents a methylene group, an ethylidene group, a propylidene group, a phenylethylidene group, a cyclohexylidene group, or an oxygen atom.

The present invention provides an electrophotographic image forming apparatus capable of outputting good images by preventing the occurrence of banding image due to slips caused when the electrophotographic photosensitive member and the charging member in contact with each other are rotated.

Further features of the present invention will become apparent from the following description of exemplary embodiments with reference to the attached drawings.

DESCRIPTION OF THE EMBODIMENTS

Figure 1:
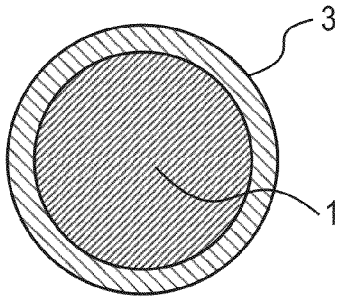
FIG. 1 is a cross-sectional view illustrating a (roller-shaped) charging member in an embodiment of the present invention.

Preferred Embodiments of the Present Invention will now be described in detail in accordance with the accompanying drawings.

The present inventors presume that in an electrophotographic image forming apparatus of the present invention, the effect for preventing the occurrence of banding image due to slips caused when the electrophotographic photosensitive member and the charging member in contact with each other are rotated, is exhibited by the following mechanism.

The surface of the charging member has irregularities derived from the bowl-shaped resin particles. Consequently, when the charging member comes in contact with the electrophotographic photosensitive member, the vibration of the charging member is suppressed due to elastic deformation of the protrusion, so that the vicinity of the protrusion is consistently in contact with the electrophotographic photosensitive member. On the other hand, when an electrophotographic image is formed, the charging member applied with a voltage charges the electrophotographic photosensitive member through discharge at a micro gap across the electrophotographic photosensitive member. The discharge is so-called Townsend discharge generated by ionization of the air in the micro gap. On that occasion, the positively and negatively charged particles generated by ionization of molecules in the air are led to the surfaces of the electrophotographic photosensitive member and the charging member by an electric field formed in the micro gap. Due to the charged particles led to the electrophotographic photosensitive member, the surface of the electrophotographic photosensitive member is charged. The charging member is also charged with charged particles having a polarity opposite to that of the charged particles led to the electrophotographic photosensitive member. On that occasion, the protrusions of the charging member are kept in a charged-up state due to the exposed insulating bowl-shaped resin particles. On the other hand, the structural unit represented by Formula (B) in the electrophotographic photosensitive member has extremely strong polarity due to a structure having two $CF_3$ groups between two phenyl groups. Consequently, due to the charged-up protrusions of the charging member coming into contact with the electrophotographic photosensitive member during image formation, the structural unit represented by Formula (B) in the electrophotographic photosensitive member is polarized. As a result, due to electrical attraction between the electrophotographic photosensitive member and the protrusions of the charging member in contact with the electrophotographic photosensitive member, the attraction between the charging member and the electrophotographic photosensitive member is enhanced. In addition, the structural unit represented by Formula (B) makes a matrix-domain structure, so that a portion with a high concentration of the structural unit represented by Formula (B) can be formed to further enhance the effect described above. With these effects combined, the attraction between the charging member and the electrophotographic photosensitive member is remarkably enhanced, so that the generation of micro-slips is suppressed during rotation of the charging member and the electrophotographic photosensitive member in contact with each other. As a result, the occurrence of banding image is suppressed.

<Electrophotographic Photosensitive Member>

[Charge Transport Layer]

In the electrophotographic photosensitive member of the present invention, the charge transport layer is the surface layer at the outermost surface.

An electrophotographic photosensitive member of the present invention includes a charge transport layer having a matrix-domain structure which includes the following matrix and the following domain. The domain includes a polyester resin A having a structural unit represented by the following Formula (A) and a structural unit represented by the following Formula (B). The matrix includes a charge-transporting substance, and at least one resin selected from the group consisting of a polyester resin C having a structural unit represented by the following Formula (C) and a polycarbonate resin D having a structural unit represented by the following Formula (D).

(A)

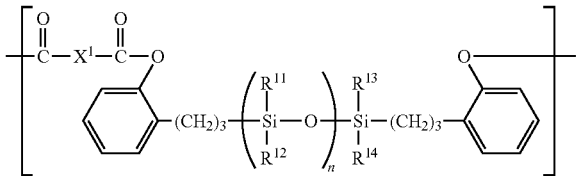

In Formula (A), $X^1$ represents a m-phenylene group, a p-phenylene group, or a bivalent group having two p-phenylene groups bonded to an oxygen atom, $R^{11}$ to $R^{14}$ each independently represent a methyl group, an ethyl group, or a phenyl group, n represents the number of repetitions of a structure in brackets, and the average value of n in the polyester resin A is 20 or more and 120 or less.

(B)

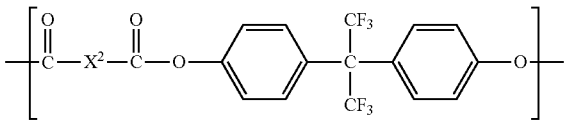

In Formula (B), $X^2$ represents a m-phenylene group, a p-phenylene group, or a bivalent group having two p-phenylene groups bonded to an oxygen atom.

(C)

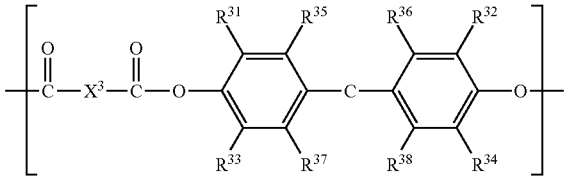

In Formula (C), $R^{31}$ to $R^{38}$ each independently represent a hydrogen atom, or a methyl group, $X^3$ represents a m-phenylene group, a p-phenylene group, or a bivalent group having two p-phenylene groups bonded to an oxygen atom, and $Y^3$ represents a single bond, a methylene group, an ethylidene group, or a propylidene group.

(D)

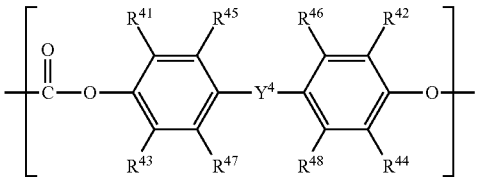

In Formula (D), $R^{41}$ to $R^{48}$ each independently represent a hydrogen atom, or a methyl group, and $Y^4$ represents a methylene group, an ethylidene group, a propylidene group, a phenylethylidene group, a cyclohexylidene group, or an oxygen atom.

[Polyester Resin A]

A polyester resin A is described below. The content of a structural unit represented by Formula (A) can be 6% by mass or more and 40% by mass or less based on the total mass of the polyester resin A. The content of a structural unit represented by Formula (B) can be 60% by mass or more and 94% by mass or less based on the total mass of the polyester resin A. More preferably the content of a structural unit represented by Formula (A) is 10% by mass or more and 40% by mass or less based on the total mass of the polyester resin A, and the content of a structural unit represented by Formula (B) is 60% by mass or more and 90% by mass or less based on the total mass of the polyester resin A.

A content of a structural unit represented by Formula (A) of 6% by mass or more and 40% by mass or less based on the total mass of the polyester resin A allows a domain to be efficiently formed in a matrix including a charge-transporting substance and at least one resin selected from the group consisting of a polyester resin C and a polycarbonate resin D. The presence of a high concentration of the structural unit represented by Formula (B) having a polar group is thereby achieved, so that the attraction between the electrophotographic photosensitive member and the charging member is enhanced. Consequently the charging member has improved driven rotation performance with enhanced effect for suppressing the banding.

With a content of the structural unit represented by the above Formula (A) of 6% by mass or more and less than 10% by mass based on the total mass of the polyester resin A, a matrix-domain structure may be also formed in the charge transport layer.

The polyester resin A includes a structural unit represented by the above Formula (A) and a structural unit represented by the above Formula (B).

In Formula (A), $X^1$ represents a m-phenylene group, a p-phenylene group, or a bivalent group having two p-phenylene groups bonded to an oxygen atom. These groups may be used singly or in combination of two or more groups. In the combination use of a m-phenylene group and a p-phenylene group, the ratio (molar ratio) of m-phenylene groups to p-phenylene groups may be from 1:9 to 9:1, more preferably from 3:7 to 7:3.

In Formula (A), n in the polyester resin A has an average value of 20 or more and 120 or less. An n of 20 or more and 120 or less allows a domain to be efficiently formed in a matrix including a charge-transporting substance, a polyester resin C and/or a polycarbonate resin D. In particular, n can have an average value of 40 or more and 80 or less.

Examples of the structural unit represented by Formula (A) are described in the followings.

(A-1)

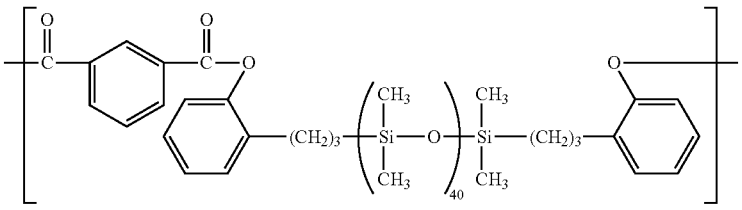

-continued (A-2)

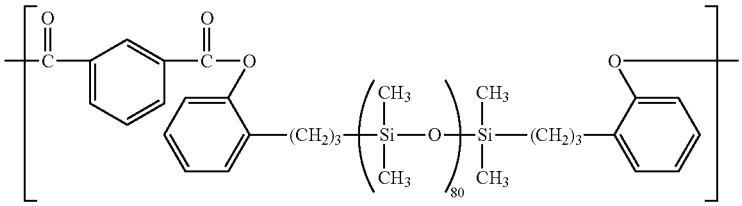

(A-3)

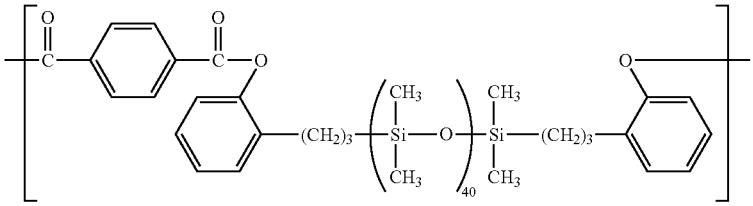

(A-4)

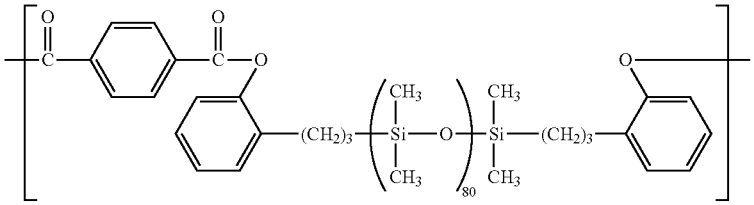

(A-5)

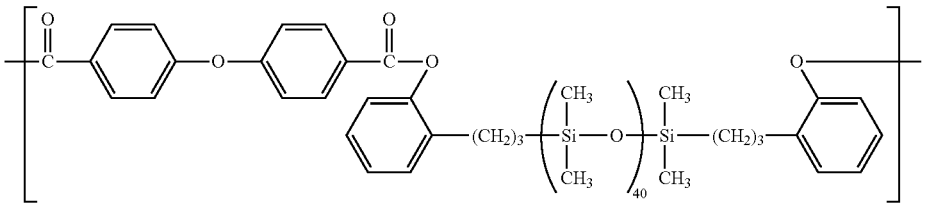

(A-6)

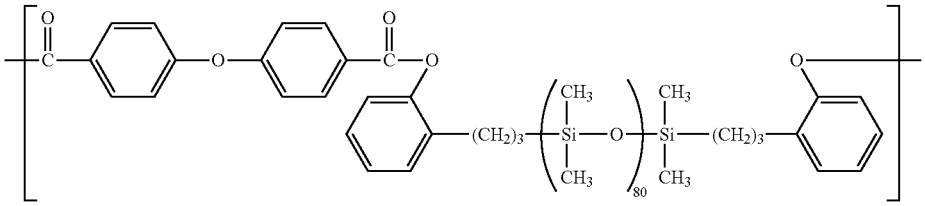

The structural units can be used singly or in combination. In the combination use of a m-phenylene group and a p-phenylene group as structural unit for $X^1$, the ratio (molar ratio) of m-phenylene groups to p-phenylene groups can be from 1:9 to 9:1, more preferably from 3:7 to 7:3.

Examples of the structural unit represented by Formula (B) are described in the followings.

(B-1)

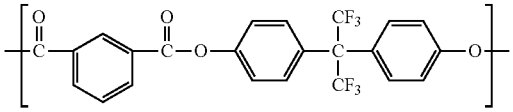

(B-2)

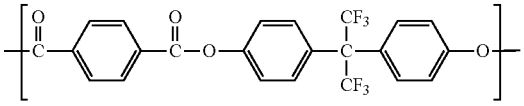

(B-3)

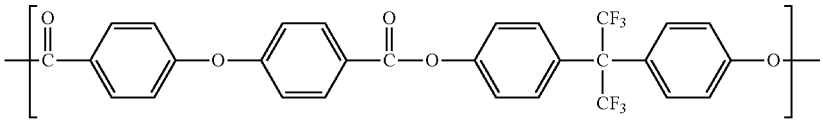

A structural unit other than the structural units represented by Formula (A) and Formula (B) may be used to constitute the polyester resin A. Examples include the structural units represented by the following Formulas (C-1) to (C-4). In the case of using structural units other than the structural unit represented by Formula (A) and the structural unit represented by Formula (B), the content of the structural units other than the structural unit represented by Formula (A) and the structural unit represented by Formula (B) is preferably 34% by mass or less based on the total mass of polyester resin A, from the viewpoint of the effect of the present invention. More preferably the content is 30% by mass or less.

The polyester resin A is a copolymer of a structural unit represented by Formula (A) and a structural unit represented by Formula (B). The copolymerization form may be any of block copolymerization, random copolymerization, alternate copolymerization, and the like.

The polyester resin A can have a weight average molecular weight of 30,000 or more and 200,000 or less, in order to form a domain in a matrix including a charge-transporting substance and a polyester resin C or a polycarbonate resin D. A weight average molecular weight of 40,000 or more and 150,000 or less is more preferable.

In the present application, the weight average molecular weight of resin is represented according to the usual method, more specifically, by a polystyrene conversion weight average molecular weight measured by a method described in Japanese Patent Application Laid-Open No. 2007-79555.

The copolymerization ratio of the polyester resin A can be confirmed by a conversion method using a peak area ratio of hydrogen atoms (hydrogen atoms which constitute resin) through $^1$H-NMR measurement of the resin, which is an usual method.

The polyester resin A can be synthesized by a method described in International Publication No. WO2010/008095.

The content of the polyester resin A can be 10% by mass or more and 40% by mass or less based on the total mass of all the resins in the charge transport layer. The content of 10% by mass or more and 40% by mass or less allows the matrix-domain structure to be stably formed, further enhancing the effect of the present invention. The polyester resin A can be used singly or in combination of two or more kinds.

[Polyester Resin C]

A polyester resin C having a structural unit represented by Formula (C) is described in the followings.

$X^3$ in Formula (C) represents a m-phenylene group, a p-phenylene group, or a bivalent group having two p-phenylene groups bonded to an oxygen atom. The groups can be used singly or in combination of two or more kinds. In the combination use of a m-phenylene group and a p-phenylene group, the ratio (molar ratio) of m-phenylene groups to p-phenylene groups can be from 1:9 to 9:1, more preferably from 3:7 to 7:3.

$Y^3$ in Formula (C) can be a propylidene group.

Examples of the structural unit represented by Formula (C) are described in the followings.

(C-1)

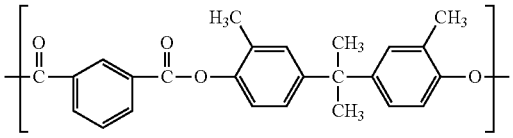

(C-2)

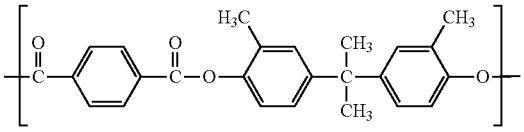

(C-3)

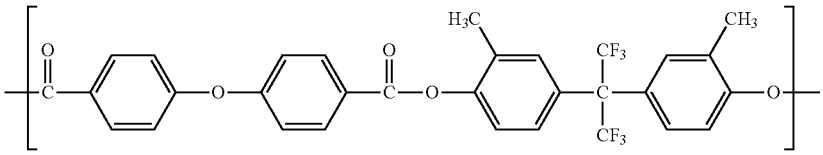

(C-4)

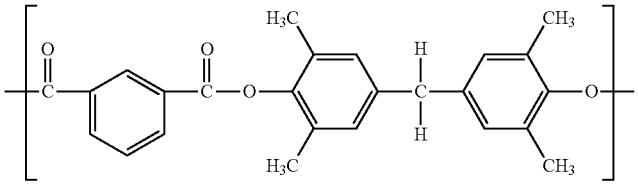

[Polycarbonate Resin D]

A polycarbonate resin D having a structural unit represented by Formula (D) is described in the followings.

$Y^4$ in Formula (D) can be a propylidene group or a cyclohexylidene group.

Examples of the structural unit represented by Formula (D) are described in the followings.

(D-1)

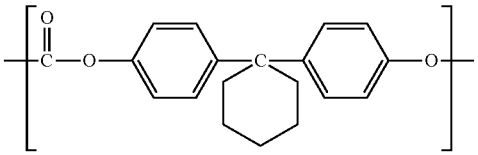

(D-2)

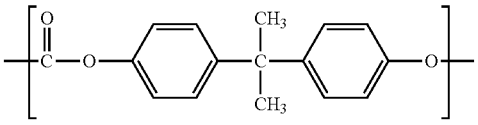

-continued (D-3)

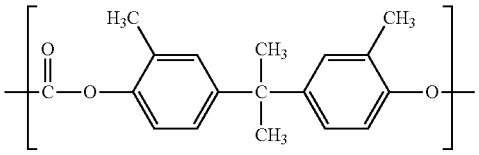

A charge transport layer of the present invention includes a matrix-domain structure having a matrix which contains at least one resin of a polyester resin C and a polycarbonate resin D and a domain which contains a polyester resin A in the matrix. A charge-transporting substance can be contained in the matrix.

The matrix-domain structure is "a sea island structure", wherein the matrix serves as a sea portion and the domain serves as an island. The domain which contains the polyester resin A has a particle-like (island-like) structure formed in a matrix which contains at least one resin of the polyester resin C and the polycarbonate resin D. The domains which contain the polyester resin A exist independently from each other in the matrix. The matrix-domain structure can be confirmed by the surface observation or section observation of the charge transport layer.

The state observation of the matrix-domain structure or the measurement of the domain structure can be performed at a predetermined magnification power with, for example, a laser microscope, an optical microscope, an electron microscope, and an atomic force microscope, which are commercially available.

The domain which contains the polyester resin A can have a number average particle size of 100 nm or more and 1,000 nm or less. The diameter of the domain portion where the component of the structural unit represented by Formula (B) is present is reduced to sufficiently smaller than the size of the protrusion of the charging member in contact with the electrophotographic photosensitive member. Consequently, the domain where the component of the structural unit represented by Formula (B) is present at high concentration is inevitably present, so that the effect of the present invention is exhibited. The particle size distribution in each of the domains can be narrow for uniformity of a coating film and stress relaxation effect. In order to obtain the number average particle size, 100 domains are arbitrarily selected from the domains in the vertically cut cross section of a charge transport layer with microscope observation. The maximum sizes of the respective selected domains are measured and averaged to obtain the number average particle size of the domains. Through the microscope observation of the cross section of a charge transport layer, image information in depth direction is obtained. The 3-dimensional image of a charge transport layer can be also obtained.

The matrix-domain structure of a charge transport layer can be formed with a coating film of a charge transport layer coating liquid, which contains a charge-transporting substance, a polyester resin A, and at least one resin of the polyester resin C and the polycarbonate resin D.

The matrix-domain structure is efficiently formed in the charge transport layer, so that the outermost surface of the electrophotographic photosensitive member maintains the matrix-domain structure, even with the surface of the electrophotographic photosensitive member being pruned during use. Consequently the improvement of the driven rotation performance of the charging member is sustained.

The content of a structural unit represented by Formula (A) based on the total mass of the polyester resin A and the content of a structural unit represented by Formula (B) can be analyzed by a commonly-used analytical method. Examples of the analytical method are described in the followings.

The charge transport layer, which is the surface layer of an electrophotographic photosensitive member, is dissolved with a solvent. Subsequently, various materials contained in the charge transport layer as the surface layer are isolated with an isolation apparatus capable of separating and collecting respective composition components of a size exclusion chromatography and a high performance liquid chromatography. The isolated polyester resin A is hydrolyzed in the presence of alkali so as to decompose into a carboxylic acid portion and a bisphenol portion. Nuclear magnetic resonance spectroscopy or mass analysis is performed on the produced bisphenol portion so as to calculate the number of repetitions of the structural unit represented by Formula (A) and the structural unit represented by Formula (B), and the molar ratio between the units, which is converted to the content (mass ratio).

Examples of the synthesis of the polyester resin A are described in the followings.

The polyester resins A described in Table 1 were synthesized by a synthesis method described in International Publication No. WO2010/008095 using raw materials corresponding to the structural unit represented by Formula (A) and the structural unit represented by Formula (B). The structure and the weight average molecular weight of each of the synthesized polyester resins A are described in Table 1.

TABLE 1

| Polyester | Formula (A) | | | | Content of | Content of | Weight average |
|---|---|---|---|---|---|---|---|
| resin A | Structural unit | Average value of n | Formula (B) | Formula (C) | formula (A) | formula (B) | molecular |
| Resin A(1) | (A-3)/(A-5) = 3/7 | 40(40/40) | (B-2)/(B-3) = 3/7 | — | 25 | 75 | 100,000 |
| Resin A(2) | (A-1)/(A-5) = 7/3 | 40(40/40) | (B-1)/(B-3) = 7/3 | — | 20 | 80 | 80,000 |
| Resin A(3) | (A-1)/(A-5) = 5/5 | 40(40/40) | (B-1)/(B-3) = 5/5 | — | 15 | 85 | 110,000 |
| Resin A(4) | (A-1)/(A-5) = 5/5 | 40(40/40) | (B-1)/(B-3) = 5/5 | — | 40 | 60 | 100,000 |
| Resin A(5) | (A-1)/(A-5) = 3/7 | 40(40/40) | (B-1)/(B-3) = 3/7 | — | 10 | 90 | 80,000 |
| Resin A(6) | (A-1)/(A-5) = 3/7 | 40(40/40) | (B-1)/(B-3) = 3/7 | — | 40 | 60 | 120,000 |
| Resin A(7) | (A-5) | 40(40/40) | (B-3) | — | 20 | 80 | 90,000 |
| Resin A(8) | (A-5) | 40(40/40) | (B-3) | — | 30 | 70 | 110,000 |
| Resin A(9) | (A-1)/(A-5) = 3/7 | 40(40/40) | (B-1)/(B-3) = 3/7 | (C-1)/(C-3) = 3/7 | 10 | 60 | 110,000 |
| Resin A(10) | (A-1)/(A-5) = 3/7 | 40(40/40) | (B-1)/(B-3) = 3/7 | — | 6 | 94 | 110,000 |

TABLE 1-continued

| Polyester resin A | Formula (A) Structural unit | Formula (A) Average value of n | Formula (B) | Formula (C) | Content of formula (A) | Content of formula (B) | Weight average molecular |
|---|---|---|---|---|---|---|---|
| Resin A(11) | (A-2)/(A-5) = 3/7 | 40(40/40) | (B-2)/(B-3) = 3/7 | — | 6 | 94 | 120,000 |
| Resin A(12) | (A-1)/(A-2)/(A-5)/(A-6) = 2.25/0.75/5.25/1.75 | 50(40/80/40/80) | (B-1)/(B-3) = 3/7 | — | 6 | 94 | 110,000 |
| Resin A(13) | (A-3)/(A-4)/(A-5)/(A-6) = 2.25/0.75/5.25/1.75 | 50(40/80/40/80) | (B-2)/(B-3) = 3/7 | — | 6 | 94 | 110,000 |

In Table 1, "Formula (A)" represents a structural unit represented by Formula (A). In the case of mixing the structural units represented by Formula (A) for use, the kinds of structural units and the mixing ratio are described. "Average value of n" represents the average value of n in the polyester resin A (the whole structural units represented by Formula (A)). In the case of mixing the structural units represented by Formula (A) for use, the average value of n for each structural unit used is described in parentheses. "Formula (B)" represents a structural unit represented by Formula (B). In the case of mixing the structural units represented by Formula (B) for use, the kinds of structural units and the mixing ratio are described. "Formula (C)" represents a structural unit represented by Formula (C). In the case of mixing the structural units represented by Formula (C) for use, the kinds of structural units and the mixing ratio are described. "Content of Formula (A)" means the content (% by mass) of the structural unit represented by Formula (A) in the polyester resin A. "Content of Formula (B)" means the content (% by mass) of the structural unit represented by Formula (B) in the polyester resin A.

The charge transport layer contains a polyester resin A and at least one resin of a polyester resin C and a polycarbonate resin D. The charge transport layer may further contain another resin. Examples of the other resin which may be contained for use include an acrylic resin, a polyester resin, and a polycarbonate resin.

The polyester resin C and the polycarbonate resin D can include no structural unit represented by Formula (A) for efficiently forming a matrix-domain structure.

[Charge-Transporting Substance]

A charge transport layer contains a charge-transporting substance. Examples of the charge-transporting substance include a triarylamine compound, a hydrazone compound, a butadiene compound, and an enamine compound. The charge-transporting substances may be used singly or in combination of two or more kinds. In particular, a triarylamine compound can be used as the charge-transporting substance for improving electrophotographic properties. A compound for use as a charge-transporting substance can contain no fluorine atom.

Examples of the charge-transporting substance are described in the followings.

(E-1)

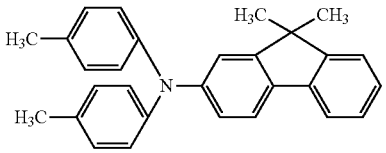

(E-2)

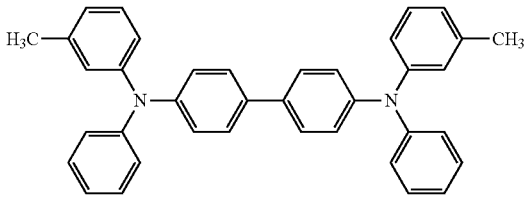

(E-3)

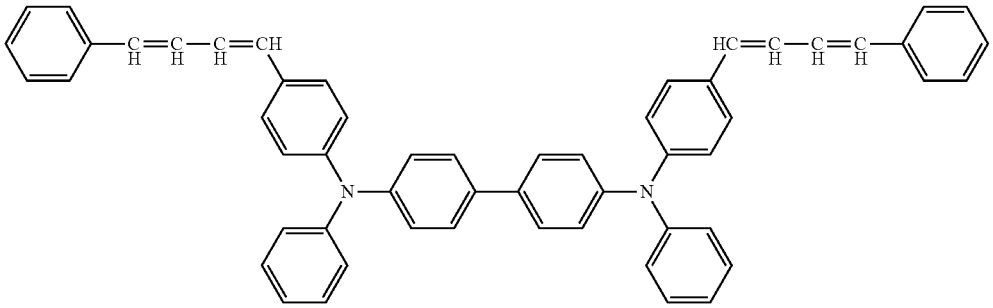

-continued (E-4)

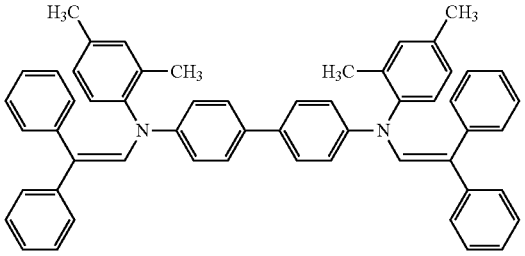

(E-5)

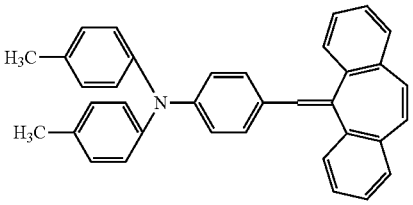

The charge transport layer can be formed with a coating film of a charge transport layer coating liquid which is obtained by dissolving a polyester resin A, a charge-transporting substance, and at least one resin selected from the group consisting of the polyester resin C and the polycarbonate resin D in a solvent.

The ratio of the charge-transporting substance to the resin can be in the range of 4:10 to 20:10 (mass ratio), more preferably in the range of 5:10 to 12:10 (mass ratio).

Examples of the solvent for use in the charge transport layer coating liquid include a ketone solvent, an ester solvent, an ether solvent, and an aromatic hydrocarbon solvent. The solvents can be used singly or in combination of two or more kinds. In particular, an ether solvent or an aromatic hydrocarbon solvent can be used from the view point of solubility of the resin.

The charge transport layer can have a film thickness of 5 μm or more and 50 μm or less, more preferably 10 μm or more and 35 μm or less.

An antioxidizing agent, an ultraviolet absorbing agent, and a plasticizing agent may be added to the charge transport layer on an as needed basis.

The charge transport layer may include a lamination structure. In that case, at least a charge transport layer on the outermost surface side includes the matrix-domain structure.

Although a cylindrical electrophotographic photosensitive member having a photosensitive layer on a cylindrical support is commonly used, a belt-like or a sheet-like shape may be employed.

[Support]

A support having electrical conductivity (electro-conductive support) can be used. A support made of metal such as aluminum, aluminum alloy, and stainless steel can be used. In the case of a support made of aluminum or aluminum alloy, an ED tube, an EI tube, or a support made from the tube which is machined, electro-chemically buffed (electrolysis with an electrode having an electrolytic action and an electrolyte solution and polishing with a grinding stone having a polishing action), or wet or dry honed may be used. Alternatively, a coating of aluminum, aluminum alloy, or indium oxide-tin oxide alloy may be formed on a support made of metal or resin by vacuum deposition. The surface of a support may be machined, roughened, or alumite-treated.

A support of resin impregnated with conductive particles such as carbon black, tin oxide particles, titanium oxide particles, and silver particles, or a plastic having a conductive resin may be also used.

[Conductive Layer]

A conductive layer may be arranged between the support and an after-mentioned undercoat layer or a charge-generating layer, in order to reduce interference fringes due to scattering of laser light or to cover a bruise on the support. The conductive layer is formed with a conductive layer coating liquid including dispersed conductive particles in a resin. Examples of the conductive particles include carbon black, acetylene black, powder of metal such as aluminum, nickel, iron, nichrome, copper, zinc, and silver, and powder of metal oxide such as conductive tin oxide and ITO.

Examples of the resin for use in the conductive layer include a polyester resin, a polycarbonate resin, a polyvinyl butyral resin, an acrylic resin, a silicone resin, an epoxy resin, a melamine resin, an urethane resin, a phenol resin, and an alkyd resin.

Examples of the solvent for the conductive layer coating liquid include an ether solvent, an alcohol solvent, a ketone solvent, and an aromatic hydrocarbon solvent.

The conductive layer can have a film thickness of 0.2 μm or more and 40 μm or less, more preferably 1 μm or more and 35 μm or less, further more preferably 5 μm or more and 30 μm or less.

[Undercoat Layer]

An undercoat layer may be arranged between a support or a conductive layer and a charge-generating layer.

The undercoat layer can be formed by applying an undercoat layer coating liquid which contains resin on the conductive layer, and by drying or curing the applied coating liquid.

Examples of the resin for use in the undercoat layer include polyacrylic acids, methyl cellulose, ethyl cellulose, a polyamide resin, a polyimide resin, a poly amide-imide resin, a polyamide acid resin, a melamine resin, an epoxy resin, a polyurethane resin, and a polyolefin resin. A thermoplastic resin can be used as the undercoat layer. Specifically, a thermoplastic polyamide resin or polyolefin resin can be suitable for use. Examples of the polyamide resin include a low-crystalline or non-crystalline copolymerized nylon applicable in a solution state. The polyolefin resin in a particle dispersion liquid sate can be usable. The polyolefin resin dispersed in an aqueous solvent can be more preferably used.

The undercoat layer can have a film thickness of 0.05 μm or more and 7 μm or less, more preferably 0.1 μm or more and 2 μm or less.

The undercoat layer may contain semiconductor particles, an electron-transporting substance, or an electron accepting substance.

[Charge-Generating Layer]

A charge-generating layer is arranged on a support, a conductive layer or an undercoat layer.

Examples of the charge-generating substance for use in the electrophotographic photosensitive member of the present invention include an azo pigment, a phthalocyanine pigment, an indigo pigment and a perylene pigment. The charge-generating substances may be used singly or in combination of two or more kinds. In particular, a metal phthalocyanine such as oxytitanium phthalocyanine, hydroxygallium phthalocyanine and chlorogallium phthalocyanine can be suitably used, having high sensitivity.

Examples of the resin used for the charge-generating layer include a polycarbonate resin, a poly ester resin, a butyral resin, a polyvinyl acetal resin, an acrylic resin, a vinyl acetate resin and a urea formaldehyde resin. In particular, a butyral resin can be suitably used. The resins can be used singly or in combination of two or more kinds as a mixture or a copolymer.

The charge-generating layer can be formed by applying a charge-generating layer coating liquid which contains a dispersed charge-generating substance with a resin and a solvent, and by drying the produced coating film. Alternatively, the charge-generating layer may be a vapor-deposited film of a charge-generating substance.

Examples of the dispersion method include a method using a homogenizer, ultrasonic waves, a ball mill, a sand mill, an attritor, or a roll mill.

The ratio of the charge-generating substance to the resin can be in the range of 1:10 to 10:1 (mass ratio), more preferably in the range of 1:1 to 3:1 (mass ratio).

Examples of the solvent for use in the charge-generating layer coating liquid include an alcohol solvent, a sulfoxide solvent, a ketone solvent, an ether solvent, an ester solvent, and an aromatic hydrocarbon solvent.

The charge-generating layer can have a film thickness of 0.01 μm or more and 5 μm or less, more preferably 0.1 μm or more and 2 μm or less.

Various sensitizers, antioxidizing agents, ultraviolet absorbing agents and plasticizing agents may be added to the charge-generating layer on an as needed basis. In order to prevent a charge flow from stagnating in the charge-generating layer, an electron-transporting substance or an electron-accepting substance may be contained in the charge-generating layer.

The charge transport layer is arranged on the charge-generating layer.

Various additives can be added to each layer of the electrophotographic photosensitive member. Examples of the additives include a degradation prevention agent such as an antioxidizing agent, an ultraviolet absorbing agent, and a light-resistant stabilizer, and fine particles such as organic fine particles and inorganic fine particles. Examples of the degradation prevention agent include a hindered phenol antioxidizing agent, a hindered amine light stabilizer, a sulfur atom-containing antioxidizing agent, and a phosphor atom-containing antioxidizing agent. Examples of the organic fine particles include polymer resin particles such as fluorine atom-containing resin particles, polystyrene fine particles, polyethylene resin particles. Examples of the inorganic fine particles include a metal oxide such as silica and alumina.

The coating liquid for each layer can be applied by an application method such as an immersion application method (an immersion coating method), a spray coating method, a spinner coating method, a roller coating method, a Mayer bar coating method, and a blade coating method. In particular, an immersion coating method is preferred.

On the surface of the charge transport layer, i.e. the surface layer of the electrophotographic photosensitive member, a concave-convex shape (a concave shape and a convex shape) having a size in the range not inhibiting the protrusions of the charging member from contacting the domain of the charge transport layer (a size sufficiently larger than or smaller than the domain diameter) may be formed. The concave-convex shape can be formed by a known method. Examples of the forming method include a method for forming a concave shape by spraying abrasive particles to the surface of the charge transport layer, a method for forming a concave-convex shape by pressure-contacting the surface of the charge transport layer with a mold having a concave-convex shape, a method for forming a concave shape by condensing dew on the surface of a coating film formed by applying a surface layer coating liquid and then by drying the dew, and a method for forming a concave shape by irradiating the surface of the charge transport layer with laser light. In particular, a method for forming a concave-convex shape by pressure-contacting the surface layer of the electrophotographic photosensitive member with a mold having a concave-convex shape can be suitably used. A method for forming a concave shape by condensing dew on the surface of a coating film formed by applying a surface layer coating liquid and then by drying the dew can be also suitably used.

The drying temperature of the coating liquid for each of the layers to form a coating film is preferably 60° C. or higher and 150° C. or lower. In particular, the drying temperature of the coating liquid for forming charge transport layer (coating liquid for forming the surface layer) is preferably 110° C. or higher and 140° C. or lower. The drying time is preferably 10 to 60 minutes, more preferably 20 to 60 minutes.

<Charging Member>

The charging member of the present invention includes an electro-conductive substrate and an electro-conductive elastic layer, the electro-conductive elastic layer including a binder and bowl-shaped resin particles fixed and exposed to the surface, the surface of the charging member having concavitys derived from the opening of the bowl-shaped resin particles and protrusions derived from the opening edge of the bowl-shaped resin particles, and the protrusion on the surface of the charging member being the exposed part of the bowl-shaped resin particle.

The charging member may be in a roller shape, a plane shape, or a belt shape. The structure of the charging member of the present invention is described in the following with reference to the charging roller illustrated in FIG. 1.

The charging roller illustrated in FIG. 1 includes an electro-conductive substrate 1 and an electro-conductive elastic layer 3 which covers the periphery of the electro-conductive substrate 1. The electro-conductive elastic layer 3 contains a binder and bowl-shaped resin particles. The electro-conductive elastic layer 3 may be formed of a plurality of layers.

The electro-conductive substrate may be bonded to the layer immediately thereabove through an adhesive. On this occasion, the adhesive can have electrical conductivity. In order to have electrical conductivity, the adhesive may include a known conductive agent. Examples of the binder for the adhesive include thermosetting resins and thermoplastic resins such as urethane-based, acryl-based, polyester-based, polyether-based, and epoxy-based known resins. The conductive agent may be appropriately selected from the following conductive fine particles and ionic conductive particles, which may be used singly or in combination of two or more kinds.

In order to achieve good charging of the electrophotographic photosensitive member, the charging member can usually have an electrical resistivity of $1\times10^{3}\Omega$ or more and $1\times10^{10}\Omega$ or less in an environment at a temperature of 23° C. and a relative humidity of 50%. In addition, the charging member can have a crown shape with a thickest part at the center in the longitudinal direction, tapered to both ends in the longitudinal direction, in the viewpoint of achieving a uniform nip width in the longitudinal direction relative to the electrophotographic photosensitive member. The crown amount (an average value of the difference between the outer diameter at the center and outer diameter at a position 90 mm away toward each of the ends) can be 30 μm or more and 200 μm or less. The hardness of the surface of the charging member is preferably 95° or less, more preferably 40° or more and 90° or less as measured with a microhardness meter (MD-1 type). With the hardness in the range, the contact with the electrophotographic photosensitive member is more reliably performed.

[Concave-Convex Structure of Charging Member Surface]

Figure 2A:
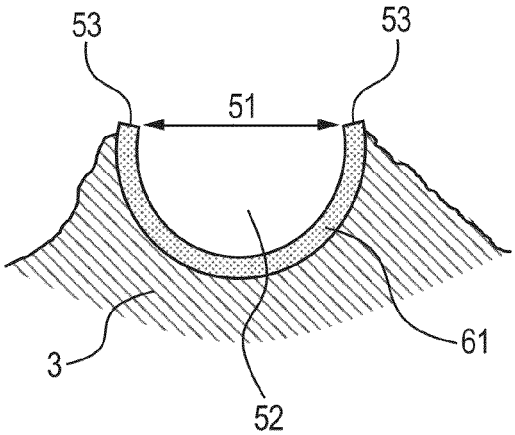
FIGS. 2A and 2B are partial cross-sectional views illustrating the surface vicinity of a charging member of the present invention.
Figure 2B:
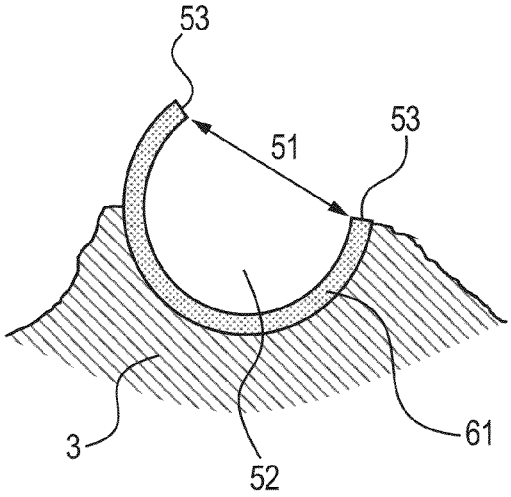

FIGS. 2A and 2B are partial cross-sectional views illustrating the surface part of the electro-conductive elastic layer of a charging member. In the charging member, the electro-conductive elastic layer includes a binder and bowl-shaped resin particles 61 fixed and exposed to the surface, and the surface of the charging member has a concavity 52 derived from the opening 51 of the bowl-shaped resin particles and a protrusion 53 derived from the opening edge of the bowl-shaped resin particles.

Examples of the "bowl-shaped resin particles" of the present invention are illustrated in FIGS. 4A to 4E. Namely, the "bowl-shaped resin particles" of the present invention represents particles having a resin-made shell 73 with a missing part which forms an opening 71, and a spherical concavity 72. The shell can have a thickness in the range of 0.1 μm or more and 3 μm or less. The shell can have an approximately uniform thickness. An approximately uniform thickness means that, for example, the thickness of the thickest part of the shell is three times or less the thickness of the thinnest part, more preferably two times or less.

Figure 4A:
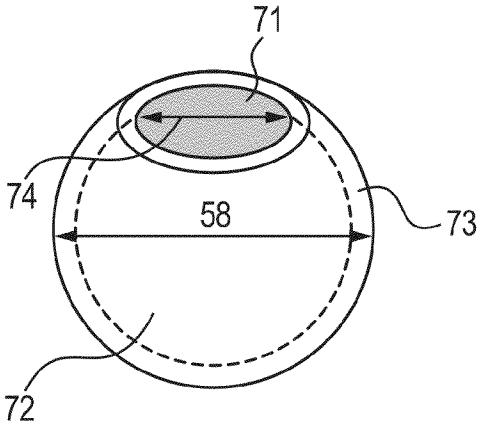
FIGS. 4A, 4B, 4C, 4D and 4E are views illustrating bowl-shaped resin particles.
Figure 4B:
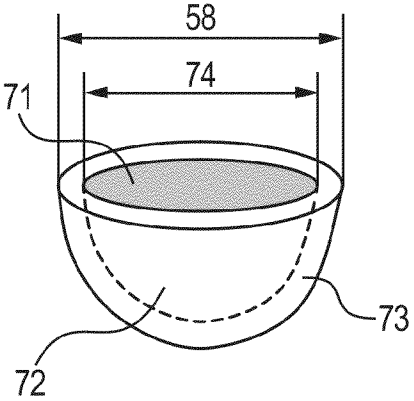
Figure 4C:
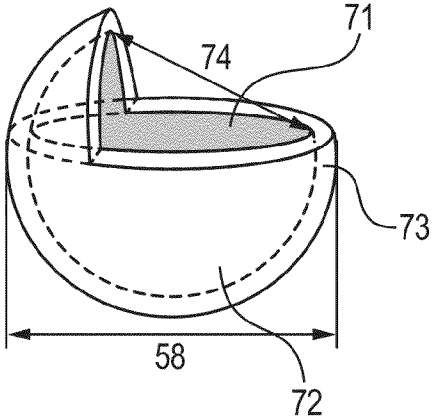
Figure 4D:
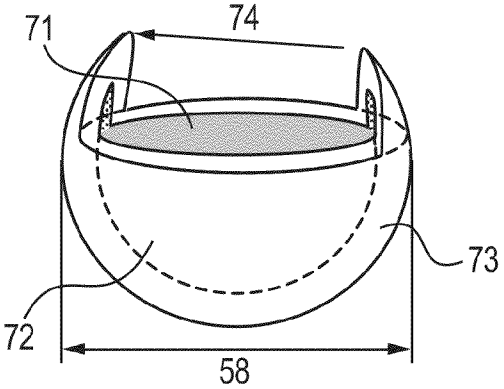
Figure 4E:
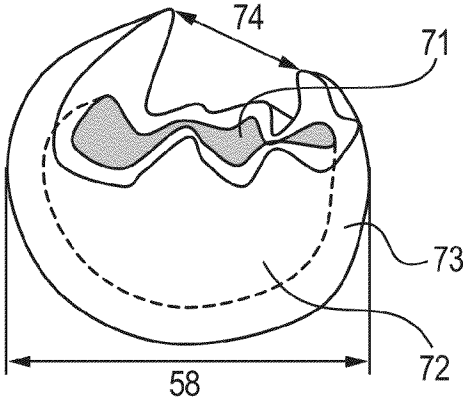

The opening 71 may have a flat edge as illustrated in FIGS. 4A and 4B, or may have a concave-convex edge as illustrated in FIG. 4C, 4D, or 4E. The maximum diameter 58 of the bowl-shaped resin particles is preferably 5 μm or more and 150 μm or less, more preferably 8 μm or more and 120 μm or less. With the maximum diameter in the range, the contact with the electrophotographic photosensitive member can be more reliably performed.

Through extensive research by the present inventors, it was found that the charging member with bowl-shaped resin particles fixed to the electro-conductive elastic layer so as to be exposed to the surface, the surface having "concavitys derived from the opening of the bowl-shaped resin particles" and "protrusions derived from the opening edge", has charging performance equivalent to that of a charging member having protrusions derived from conventional resin particles even after a long-term use. In addition, it was confirmed that the protrusion derived from the opening edge exhibits larger elastic deformation when contacted with the electrophotographic photosensitive member compared with the protrusion derived from conventional resin particles.

Figure 8A:
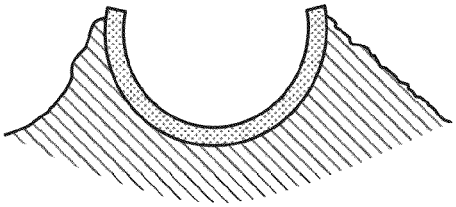
FIGS. 8A, 8B, 8C and 8D are enlarged views illustrating the vicinity of contact part between the charging member and the electrophotographic photosensitive member of the present invention.
Figure 8B:
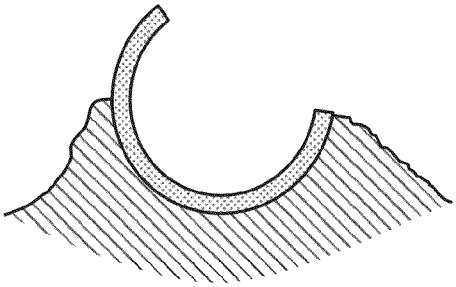
Figure 8C:
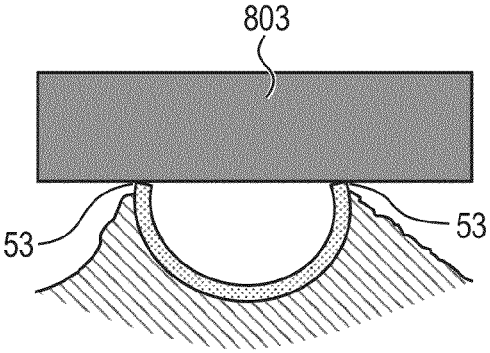
Figure 8D:
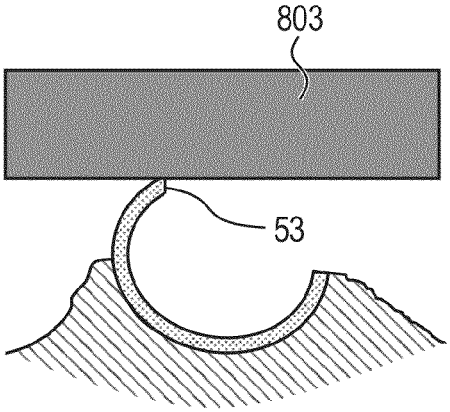

FIGS. 8A and 8B are schematic views illustrating the state of a charging member having a concavity and a protrusion as illustrated in FIGS. 2A and 2B, respectively, prior to contact with the electrophotographic photosensitive member. FIGS. 8C and 8D are schematic views illustrating the nip state of a charging member having a concavity and a protrusion as illustrated in FIGS. 2A and 2B, respectively, when contacted with the electrophotographic photosensitive member. The elastic deformation of the opening edge 53 of the bowl-shaped resin particles 61 due to contact pressure with the electrophotographic photosensitive member 803 was observed. It is presumed that the elastic deformation enhances the gripping force of the charging member to the electrophotographic photosensitive member, stabilizing the contact state between the charging member and the electrophotographic photosensitive member.

The bowl-shaped resin particles to form protrusions are fixed and exposed to the surface of charging member, acting on the electrostatic attraction between the protrusions derived from the opening edge of the bowl-shaped resin particles and the electrophotographic photosensitive member. As a result, the protrusions formed of exposed bowl-shaped resin particles are required to have insulation properties for keeping the charged-up state. The insulation properties of the resin to form the bowl-shaped resin particles are required to be about $10^{10}$ Ωcm or more. The resin for use in the bowl-shaped resin particles to form protrusions can contain a resin having a polar group. The presence of the polar group in the protrusions, i.e. the contact part with the charged electrophotographic photosensitive member, enhances electrical attraction at the contact part with the electrophotographic photosensitive member, resulting in further improved driven rotation properties of the charged member.

Examples of the specific resin include an acrylonitrile resin, a vinyl chloride resin, a vinylidene chloride resin, a methacrylic acid resin, a styrene resin, an urethane resin, an amide resin, a methacrylonitrile resin, an acrylic acid resin, anacrylic acid ester resin, and a methacrylic acid ester resin. In particular, at least one thermoplastic resin selected from acrylonitrile resin and methacrylonitrile resin can be used from the viewpoint of having a strong polar group. The thermoplastic resins may be used singly or in combination of two or more kinds. Furthermore, raw material monomers for the thermoplastic resins may be copolymerized for use as copolymers.

Figure 3:
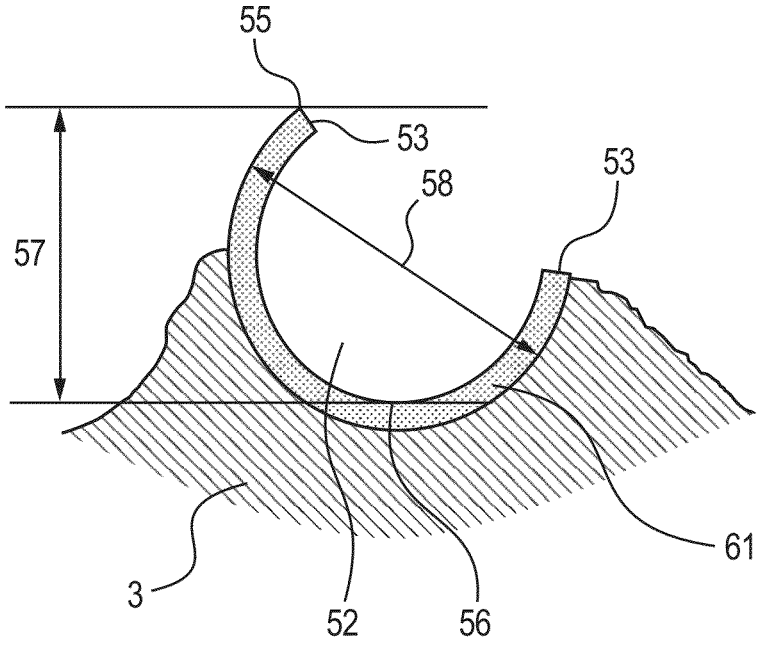
FIG. 3 is a partial cross-sectional view illustrating the surface vicinity of a charging member of the present invention.

The difference in height 57 between the apex 55 of a protrusion derived from the opening edge of the bowl-shaped resin particles and the bottom 56 of a concavity 52 derived from the opening of the bowl-shaped resin particles illustrated in FIG. 3 is preferably 5 μm or more and 100 μm or less, more preferably 8 μm or more and 80 μm or less. The height difference in the range enables more reliable contact with the electrophotographic photosensitive member. The ratio of the maximum diameter 58 of the bowl-shaped resin particles to the difference in height 57, i.e. [maximum diameter]/[difference in height] can be 0.8 or more and 3.0 or less. The ratio in the range enables more reliable contact between the protrusion 53 derived from the opening of the bowl-shaped resin particles and the electrophotographic photosensitive member.

Due to formation of the concave-convex shape, the surface state of the electro-conductive elastic layer can be controlled as follows. The ten point average surface roughness (Rzjis) can be 5 μm or more and 65 μm or less. The Rzjis in the range enables more reliable contact with the electrophotographic photosensitive member. The average interval of surface irregularities (Sm) is preferably 20 μm or more and 200 μm or less, more preferably 30 μm or more and 150 μm or less. The Sm in the range results in a short average interval of surface irregularities and an increased number of contact points with the electrophotographic photosensitive member. Consequently, polarization of the structural unit represented by Formula (B) contained in the electrophotographic photosensitive member is more easily induced, and the electrostatic attraction force between the electrophotographic photosensitive member and the protrusions of the charging member is enhanced, enabling more reliable contact with the electrophotographic photosensitive member. The measurement methods of the ten point average roughness (Rzjis) of the surface and the average interval of surface irregularities (Sm) are described in detail in the following.

The ratio of the maximum diameter 58 of the bowl-shaped resin particles to the minimum diameter 74 of the opening, i.e.

[maximum diameter]/[minimum diameter of opening] of the bowl-shaped resin particles, can be 1.1 or more and 4.0 or less. The ratio in the range enables more reliable contact with the electrophotographic photosensitive member.

The difference between the outer diameter and the inner diameter of the peripheral edge of the opening of the bowl-shaped resin particles (shell thickness) can be 0.1 μm or more and 3 μm or less. The difference in the range enables more reliable contact with the electrophotographic photosensitive member. The contact with the electrophotographic photosensitive member can be further enhanced with the difference between the outer diameter and the inner diameter being approximately uniformly formed over the whole area of the particle. The term "approximately uniform" means a range within ±50% of the average value.

[Electro-Conductive Elastic Layer]

[Binder]

As a binder contained in the electro-conductive elastic layer of the charging member, a known rubber or resin may be used. Examples of the rubber include natural rubber, vulcanized natural rubber, and synthetic rubber. Examples of the synthetic rubber include ethylene propylene rubber, styrene butadiene rubber (SBR), silicone rubber, urethane rubber, isoprene rubber (IR), butyl rubber, acrylonitrile butadiene rubber (NBR), chloroprene rubber (CR), acrylic rubber, epichlorohydrin rubber, and fluorine rubber. Examples of the resins include resins such as a thermosetting resin and a thermoplastic resin. In particular, a fluorine resin, a polyamide resin, an acrylic resin, a polyurethane resin, an acrylic urethane resin, a silicone oil, and a butyral resin can be used. The use of the material enables more reliable contact with the electrophotographic photosensitive member. These may be used singly or two or more kinds may be mixed for use. Alternatively the monomers as binder raw materials may be copolymerized to form a copolymer.

The electro-conductive elastic layer may be formed by adding a cross-linking agent to a prepolymerized binder raw material for curing or cross-linking. In the present invention, the mixture is referred to as a binder in the following description.

[Electro-Conductive Fine Particles]

The electro-conductive elastic layer of the charging member may contain electro-conductive fine particles for exhibiting conductivity. Specific examples of the conductive fine particles include metal oxides, metal fine particles, and carbon black. The electro-conductive fine particles may be used singly or in combination of two or more kinds. The target content of the electro-conductive fine particles in the electro-conductive elastic layer is 2 to 200 parts by mass, preferably 5 to 100 parts by mass, based on 100 parts by mass of the binder. The kinds of the binders and the electro-conductive fine particles for use in the first electro-conductive elastic layer and the second electro-conductive elastic layer may be the same or different.

[Forming Method of Electro-Conductive Elastic Layer]

The method for forming the electro-conductive elastic layer is described in the following.

A cover layer including electro-conductive fine particles and hollow resin particles dispersed in a binder (hereinafter also referred to as "preliminary cover layer") is formed on an electro-conductive substrate. Subsequently, the surface of the preliminary cover layer is ground, so that a part of the hollow resin particle is removed to form into a bowl shape. The bowl-shaped resin particles are thereby fixed and exposed to the surface of the electro-conductive elastic layer, and concavitys derived from the openings of the bowl-shaped resin particles and protrusions derived from the opening edges of the bowl-shaped resin particles are formed (hereinafter also referred to as "concave-convex shape due to openings of bowl-shaped resin particles").

[1-1. Dispersion of Resin Particles into Preliminary Cover Layer]

First, methods for dispersing hollow resin particles into the preliminary cover layer are described.

One method includes: forming a coating film of an electro-conductive resin composition including hollow particles containing gas inside, which are dispersed together with a binder and electro-conductive fine particles, on an electro-conductive substrate; and drying, curing, or cross-linking the coating film. Examples of the material for the hollow resin particles include a resin as the binder or a known resin.

Another method may be, for example, a method using so-called thermally expandable microcapsules including an encapsulated substance in particles, which expands when heated so as to form hollow resin particles. The method includes: preparing an electro-conductive resin composition including thermally expandable microcapsules dispersed together with a binder and electro-conductive fine particles; forming a layer of the composition on an electro-conductive substrate; and drying, curing, or cross-linking the layer. In the method, the encapsulated substance expands by the heat due to drying, curing, or cross-linking of the binder for use in the preliminary cover layer, so that the hollow resin particles can be formed. On this occasion, the particle diameter may be controlled through control of the temperature conditions.

In the case of using thermally expandable microcapsules, a thermoplastic resin is required to be used as a binder.

Examples of the thermoplastic resin include an acrylonitrile resin, a vinyl chloride resin, a vinylidene chloride resin, a methacrylic acid resin, a styrene resin, a urethane resin, an amide resin, a methacrylonitrile resin, an acrylic acid resin, an acrylic acid ester resin, and a methacrylic acid ester resin. In particular, at least one thermoplastic resin selected from an acrylonitrile resin, a vinylidene chloride resin, and a methacrylonitrile resin, which have low gas permeability and high impact resilience, can be used. These resins are preferred due to easiness of preparing resin particles for use in the present invention and easiness of dispersion into a binder. These thermoplastic resins may be used singly or in combination of two or more kinds. Furthermore, raw material monomers for the thermoplastic resins may be copolymerized for use as a copolymer.

The substance encapsulated in the thermally expandable microcapsule can evaporates at a temperature equal to or lower than the softening point of the thermoplastic resin for use in a binder. Examples of the material include: a low boiling point liquid such as propane, propylene, butene, n-butane, isobutane, n-pentane, isopentane; and a high boiling point liquid such as n-hexane, isohexane, n-heptane, n-octane, isooctane, n-decane, and isodecane.

The thermally expandable microcapsule can be manufactured by a known method such as suspension polymerization, interfacial polymerization, interfacial precipitation, and drying in liquid. Examples of the suspension polymerization include a method including: mixing polymerizable monomers, a substance to be encapsulated in the thermal expansion microcapulsule, and a polymerization initiator; dispersing the mixture in an aqueous vehicle which contains a surfactant and a dispersion stabilizer; and then performing suspension polymerization. Optionally, a compound having a reactive group to react with a functional group of polymerizable monomers and an organic filler may be added.

Examples of the polymerizable monomer include: acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, and vinyl acetate; acrylic acid esters (methyl acrylate, ethyl acrylate, n-butyl acrylate, isobutyl acrylate, t-butyl acrylate, isobornyl acrylate, cyclohexyl acrylate, and benzyl acrylate); methacrylic acid esters such as methyl methacrylate, ethyl methacrylate, n-butyl methacrylate, isobutyl methacrylate, t-butyl methacrylate, isobornyl methacrylate, cyclohexyl methacrylate, benzyl methacrylate; styrene monomer, acrylamide, substituted acrylamide, methacrylamide, substituted methacrylamide, butadiene, s-caprolactam, polyether, and isocyanate. These polymerizable monomers may be used singly or in combination of two or more kinds.

As a polymerization initiator, a known peroxide initiator and an azo initiator can be used. In particular, an azo initiator is preferred from the viewpoints of polymerization control, compatibility with solvent, and handling safety. Specific examples of the azo initiator include: 2,2'-azobis-isobutyronitrile, 1,1'-azobis-cyclohexane-1-carbonitrile, 2,2'-azobis-4-methoxy-2,4-dimethyl valeronitrile, and 2,2'-azobis-2,4-dimethyl valeronitrile. In particular, 2,2'-azobis-isobutyronitrile can be used from the viewpoint of efficiency of the initiator. In the case of using a polymerization initiator, the amount can be 0.01 to 5 parts by mass based on 100 parts by mass of polymerizable monomers. With an amount in the range, a polymer having sufficient degree of polymerization can be obtained due to active effect of the polymerization initiator.

As a surfactant, an anionic surfactant, a cationic surfactant, a nonionic surfactant, an ampholytic surfactant, and a polymer-type dispersant can be used. In the case of using a surfactant, the amount can be 0.01 to parts by mass based on 100 parts by mass of polymerizable monomers. Examples of the dispersion stabilizer include organic fine particles (polystyrene fine particles, polymethyl methacrylate fine particles, polyacrylic acid fine particles, polyepoxide fine particle, and the like), silica (colloidal silica and the like), calcium carbonate, calcium phosphate, aluminum hydroxide, barium carbonate, and magnesium hydroxide. In the case of using a dispersion stabilizer, the amount can be 0.01 to 20 parts by mass based on 100 parts by mass of polymerizable monomers. Within the range, the dispersion is stabilized and thickening of solvent, i.e. a harmful effect due to increase of unadsorbed dispersant, can be prevented.

Suspension polymerization can be performed in an enclosed pressure-resistant container so as to prevent evaporation or sublimation of monomers and solvent due to gasification. The suspension may be prepared by suspending with a disperser and then transferred to a pressure-resistant container for suspension polymerization. Alternatively the suspension may be prepared by suspending and polymerized in a pressure-resistant container. The polymerization temperature can be 50° C. to 120° C. Within the range, a target polymer having a sufficient degree of polymerization can be obtained. Although the polymerization may be performed under atmospheric pressure, the polymerization can be performed under pressure (under a pressure of atmospheric pressure plus 0.1 to 1 MPa) for prevention of gasification of the material to be enclosed in the thermally expandable microcapsule. After completion of the polymerization, solid-liquid separation and cleaning may be performed by centrifugation and filtration. In the case that solid-liquid separation and cleaning are performed, drying and pulverization may be then performed at a temperature equal to or lower than the softening temperature of the resin constituting the thermally expandable microcapsule. Drying and pulverization may be performed by a known method with use of a flash dryer, a fair-wind dryer, and a Nauta mixer. Alternatively drying and pulverization may be performed at the same time, by using a pulverizing dryer. A surfactant and a dispersion stabilizer can be removed by repeating cleaning filtration after manufacturing.

[1-2. Forming Method of Preliminary Cover Layer and Electro-Conductive Elastic Layer]

The forming method of a preliminary cover layer is described in the following. Examples of the forming method of a preliminary cover layer include electrostatic spray coating, dip coating, roller coating, bonding or covering with a layer in a sheet form or a tube form having a predetermined film thickness, and curing and forming a material into a predetermined shape. Particularly in the case of a binder of rubber, an electro-conductive substrate and an unvulcanized rubber composition may be integrally extruded with an extruder having a crosshead. The crosshead is an extrusion molding mold installed at the cylinder tip of an extruder for use in making a cover layer of electric cables and wires.

After formation of the preliminary cover layer, the surface of the preliminary cover layer through subjected to drying, curing, or cross-linking is ground, so that a part of the hollow resin particle is removed to form into a bowl shape. The bowl-shaped resin particles are thereby fixed and exposed to the surface of the electro-conductive elastic layer, and concavitys derived from the opening of the bowl-shaped resin particles and protrusions derived from the opening edge of the bowl-shaped resin particles are formed. As the grinding method, a cylindrical grinding method and a tape grinding method may be employed. Examples of the cylindrical grinding machine include a traverse-type NC cylindrical grinding machine and a plunge cutting-type NC cylindrical grinding machine.

Hollow resin particles have high impact resilience, due to the gas encapsulated inside. As the binder for the electro-conductive elastic layer, therefore, a rubber or resin having relatively low impact resilience and small stretchability can be selected. A state that the electro-conductive elastic layer is easily ground and the hollow resin particles are hardly ground can be thereby achieved. When the electro-conductive elastic layer in the state is ground, only a part of the hollow resin particles is removed, so that bowl-shaped resin particles can be formed. As a result, openings of the bowl-shaped resin particles can be formed in the surface of the electro-conductive elastic layer. Since the present method utilizes the difference in grindability between the hollow resin particles and the preliminary cover layer so as to form concavitys derived from the opening and protrusions derived from the opening edge, a rubber can be used as the binder for use in the electro-conductive elastic layer. More specifically, an acrylonitrile-butadiene rubber, a styrene-butadiene rubber, or a butadiene rubber, which has low impact resilience and small stretchability, can be suitably used.

Further, the hollow resin particles can contain a polar group, from the viewpoint that the shell has low gas permeability and high impact resilience. Examples of the resin include a resin having a unit represented by the following Formula (1). Further, from the viewpoint of easiness of grinding control, the resin having both of the unit represented by Formula (1) and a unit represented by Formula (5) is more preferred.

Formula (1)

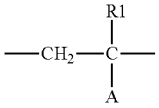

In Formula (1), A is at least one selected from the group consisting of the following Formulae (2), (3), and (4). R1 is a hydrogen atom or an alkyl group having a carbon number of 1 to 4.

Formula (2)

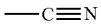

Formula (3)

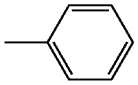

(Formula 4)

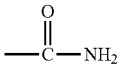

Formula (5)

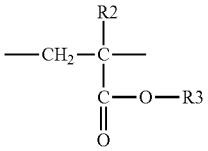

In Formula (5), R2 is a hydrogen atom, or an alkyl group having a carbon number of 1 to 4, and R3 is a hydrogen atom, or an alkyl group having a carbon number of to 10. R2 and R3 may have the same structure or the different structure.

[1-3. Grinding Method]

As the grinding method, a cylindrical grinding method and a tape grinding method may be employed. Since it is required to derive the marked difference in grindability between materials, conditions for faster grinding are desired. From this viewpoint, use of a cylindrical grinding method is preferred. Among cylindrical grinding methods, use of a plunge cutting method is more preferred from the viewpoint of capable of simultaneous grinding in the longitudinal direction with a shortened grinding time. From the viewpoint of forming a uniform ground surface, a conventionally performed spark-out process (grinding process at a penetration rate of 0 mm/minute) can be curtailed or eliminated.

As an example, an electro-conductive elastic layer can be ground with a plunge cutting-type cylindrical grinding machine under conditions in the following range. The rotating speed of a cylindrical grinding stone is preferably 1000 rpm or more and 4000 rpm or less, more preferably 2000 rpm or more and 4000 rpm or less. The penetration rate into the electro-conductive elastic layer is preferably 5 mm/minute or more and 30 mm/minute or less, more preferably 10 mm/minute or more. At the end of penetration process, the ground surface may be subjected to leveling at a penetration rate of 0.1 mm/minute to 0.2 mm/minute for 2 seconds or less. The spark-out process (grinding process at a penetration rate of 0 mm/minute) can be performed for 3 seconds or less. In the case of a member having the electro-conductive elastic layer in a rotatable shape (e.g. roller shape), the rotating speed is preferably 50 rpm or more and 500 rpm or less, more preferably 200 rpm or more and 500 rpm or less. With the conditions for the penetration rate into the electro-conductive elastic layer and the spark-out process, the concave-convex shape due to opening of bowl-shaped resin particles can be more easily formed on the surface of the electro-conductive elastic layer.

A roller with the ground electro-conductive elastic layer can be directly used as the charging member of the present invention. Alternatively, a roller having a structure with a first electro-conductive elastic layer made of the ground electro-conductive elastic layer and a second electro-conductive elastic layer formed on the surface thereof can be used as the charging member of the present invention.

[2. Electron Beam Irradiation]

Figure 9:
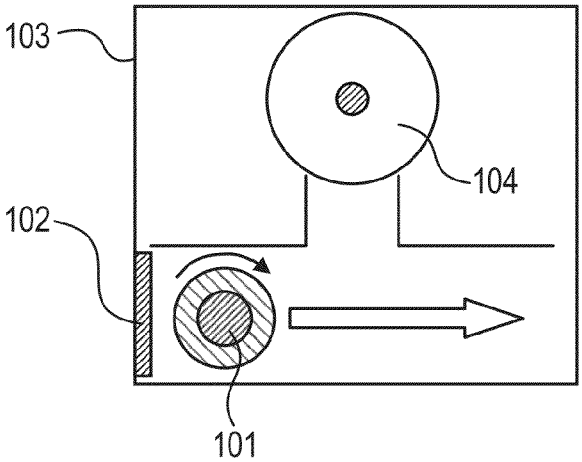
FIG. 9 is a schematic view illustrating the electrophotographic image forming apparatus for use in an embodiment of the present invention.

Further, after formation of the ground electro-conductive elastic layer, the surface may be subjected to UV irradiation or electron beam irradiation. In FIG. 9, a schematic view illustrating the method for irradiating a roller-shaped member having the electro-conductive elastic layer with electron beams in an embodiment. First, a member 101 having the electro-conductive elastic layer is disposed on a rotary jig (not shown in drawing), and brought inside an electron beam irradiation apparatus 103 through an input port 102 equipped with a shutter. Subsequently, the shutter is closed and the internal atmosphere of the electron beam irradiation apparatus is substituted with nitrogen. After confirming that the oxygen concentration is reduced to a level of 100 ppm or less, electron beams are irradiated from an electron beam generation part 104. The electron beam generation part 104 includes a vacuum chamber for accelerating electron beams and a negative electrode in a filament form. When the negative electrode is heated, thermal electrons are emitted from the surface. The thermal electrons thus emitted are accelerated by acceleration voltage and then emitted as electron beams. The number of electron beams (irradiation dose) emitted from the negative electrode can be controlled by changing the shape of filament and the heating temperature of filament.

The irradiation dose of electron beams in electron beam irradiation is defined by the following Expression (1).

$$D=(K\cdot I)/V \quad (1)$$

In Expression (1), D is dose (kGy), K is apparatus constant, I is electronic current (mA), and V is processing speed (m/minute). The apparatus constant K is a constant representing the efficiency of individual apparatus, i.e. an index of the performance of apparatus. The apparatus constant K can be obtained from measurement of the dose by changing the electronic current and the processing speed under fixed acceleration voltage conditions. For the measurement of the dose of electron beams, a dose measurement film is stuck to the roller surface so as to be actually processed with an electron beam irradiation apparatus, and the electron beam dose of the dose measurement film is measured with a film dosemeter. The dose measurement film is a FWT-60, and the film dosemeter is a FWT-92D type (both made by Far West Technology, Inc.). The electron beam dose of the present invention can be in the range of 30 kGy or more from the viewpoint of surface modification effect and 3000 kGy or less from the viewpoints of preventing excessive cross-linking and disintegration of the surface.

[Other Components in Electro-Conductive Elastic Layer]

The electro-conductive elastic layer of a charging member may include an ionic conductive agent and insulating particles, in addition to the electro-conductive fine particles.

Examples of the ionic conductive agent include a perchlorate such as $LiClO_4$ and $NaClO_4$, and a quaternary ammonium salt, which may be singly used or in combination of two or more kinds.

Examples of the insulating particles include particles of zinc oxide, tin oxide, indium oxide, titanium oxide (titanium dioxide, titanium monoxide and the like), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, hydrotalcite, dolomite, talc, kaolin clay, mica, aluminum hydroxide, magnesium hydroxide, zeolite, wollastonite, diatomaceous earth, glass beads, bentonite, montmorillonite, hollow glass spheres, organometal compounds and organometal salts.

[Volume Resistivity of Electro-Conductive Elastic Layer]

The target volume resistivity of the electro-conductive elastic layer can be $1\times10^{2}\Omega$ or more and $1\times10^{16}\Omega$ or less in an environment at a temperature of 23° C. and a relative humidity of 50%. With a volume resistivity in the range, proper charging of an electrophotographic photosensitive member can be more easily performed by discharge.

The volume resistivity of the electro-conductive elastic layer is obtained as described below. First, the electro-conductive elastic layer in a rectangular form with approximately 5 mm long by 5 mm wide by 1 mm thick is cut out from a charging member. A metal is vapor deposited on both surfaces to form an electrode and a guard electrode, so that a sample for measurement can be obtained. In the case that the thin film electro-conductive elastic layer cannot be cut out, an aluminum sheet is coated with an electro-conductive elastic composition for forming the electro-conductive elastic layer so as to form a coating film. A metal is vapor deposited on the coating film surface, so that a sample for measurement can be obtained. A voltage of 200 V is applied to the obtained measurement sample using a microammeter (trade name: ADVANTEST R8340A ULTRAHIGHRESISTANCE METER made by Advantest Corporation). After 30 seconds, the current is measured, and the volume resistivity is calculated from the film thickness and the electrode area. The volume resistivity of an electro-conductive elastic layer can be controlled by the electro-conductive fine particles and the ionic conductive agent. The electro-conductive fine particles have a target average particle size of 0.01 μm to 0.9 μm, preferably 0.01 μm to 0.5 μm. The target content of electro-conductive fine particles in the electro-conductive elastic layer is 2 to 80 parts by mass, preferably 20 to 60 parts by mass based on 100 parts by mass of a binder.

[Electro-Conductive Substrate]

The electro-conductive substrate for use in the charging member of the present invention has conductive properties and a function for supporting the electro-conductive elastic layer and the like disposed thereon. Examples of the material include a metal such as iron, copper, stainless steel, aluminum, nickel, and an alloy thereof.

<Electrophotographic Image Forming Apparatus>

Figure 6:
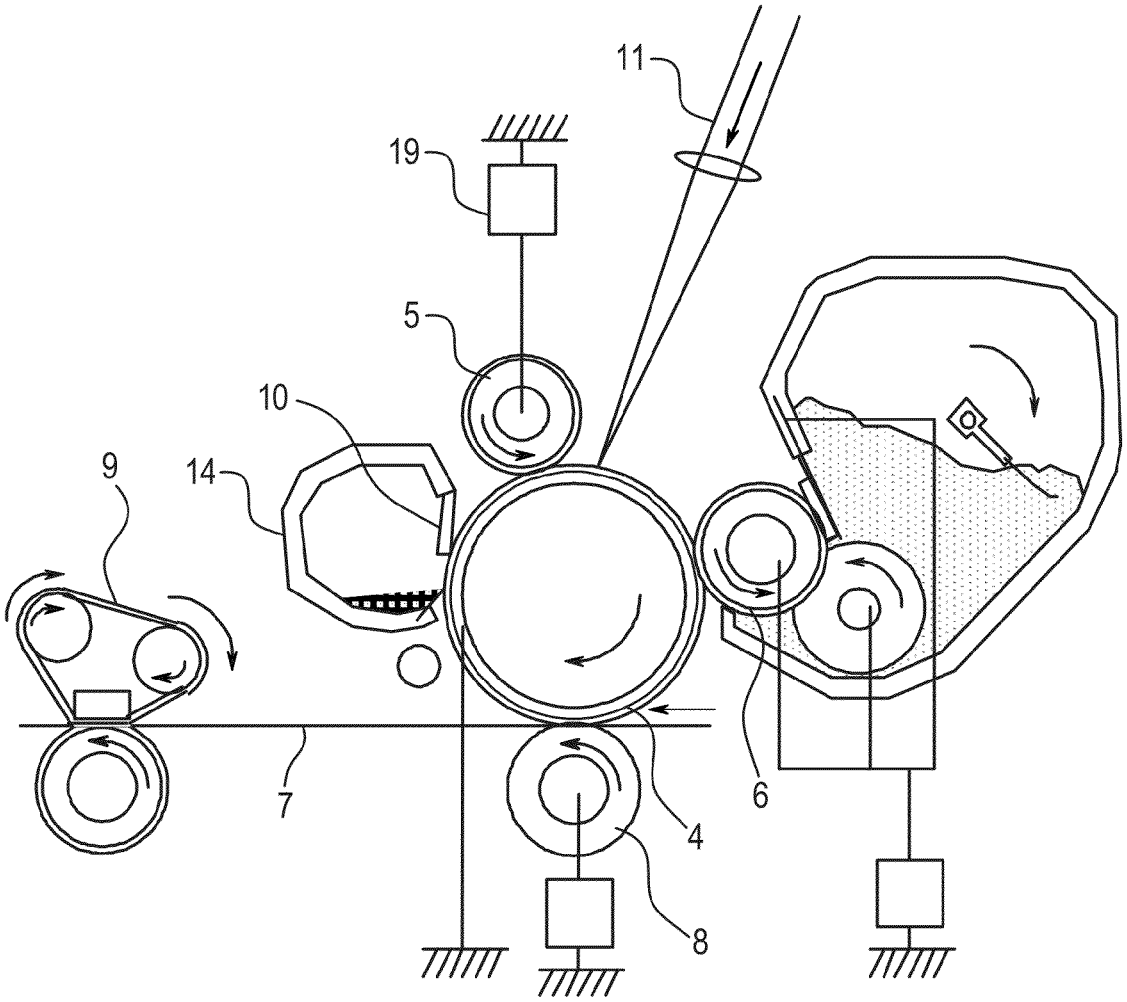
FIG. 6 is a schematic cross-sectional view illustrating the electrophotographic image forming apparatus in an aspect of the present invention.

The electrophotographic image forming apparatus in an embodiment of the present invention is illustrated in FIG. 6. The electrophotographic image forming apparatus of the present invention includes: an electrophotographic image processing cartridge having an electrophotographic photosensitive member, a charging unit, a developing unit, and a cleaning unit, and the like which are integrated; a latent image forming unit; a developing unit; a transfer unit; a fixing unit and the like.

The electrophotographic photosensitive member 4 is of a rotary drum type having a photosensitive layer on an electro-conductive substrate, being rotation-driven in the arrow direction at a specified circumferential velocity (process speed). The charging unit includes a contact-type charging roller 5 disposed in contact with the electrophotographic photosensitive member 4 at a specified pressing force. A specified DC voltage is applied to the charging roller 5 driven to rotate following the rotation of the electrophotographic photosensitive member from a charging power source 19, so that the electrophotographic photosensitive member is charged to a specified potential. Examples of the latent image forming unit 11 for forming an electrostatic latent image on the electrophotographic photosensitive member 4 include an exposure unit such as laser beam scanner. The uniformly charged electrophotographic photosensitive member is subjected to exposure corresponding to image data, so that an electrostatic latent image is formed. The developing unit includes a developing sleeve or a developing roller 6 disposed adjacent to or in contact with the electrophotographic photosensitive member 4. By reversal development of the supplied toner electrostatically processed to have the same polarity as the charged polarity of the electrophotographic photosensitive member, the electrostatic latent image is developed to form a toner image. The transfer unit has a contact-type transfer roller 8. The toner image is transferred from the electrophotographic photosensitive member to a transfer material 7 such as plain paper. The transfer material is transported with a paper feeding system having a transport member. After transfer, the cleaning unit having a blade-type cleaning member 10 and a collection container 14, mechanically scrapes off the transfer residual toner remaining on the electrophotographic photosensitive member for collection. By employing cleaning simultaneously with development for collection of the transfer residual toner in a developing unit, a cleaning unit may be omitted. The fixing unit 9 including a heated roll fixes the transferred toner image on the transfer material 7 and discharges the transfer material outside of the unit.

EXAMPLES

The present invention is described in further detail in the following with reference to specific Examples. However, the present invention is not limited thereto. In the Examples, "part" means "mass part".

Prior to description of Examples, manufacturing examples A1 to A22 of electrophotographic photosensitive members, the evaluation method of electrophotographic photosensitive members, the evaluation method of charging members and resin particles, manufacturing examples b1 to b11 of resin particles, manufacturing examples c1 to c18 of electro-conductive rubber compositions, and manufacturing examples T1 to T21 of charging members are described.

Manufacturing Example A1 of Electrophotographic Photosensitive Member

An aluminum cylinder having a diameter of 24 mm and a length of 261.6 mm was used as a support.

Subsequently, a coating liquid for forming an electro-conductive layer was prepared from 10 parts of $SnO_2$-coated barium sulfate (electro-conductive particles), 2 parts of titanium oxide (resistance adjusting pigment), 6 parts of phenol resin (binder resin), 0.001 parts of silicone oil (leveling agent), and a mixed solvent of 4 parts of methanol and 16 parts of methoxy propanol.

The coating liquid for forming an electro-conductive layer was immersion-coated on the support, and cured (thermally cured) at 140° C. for 30 minutes, so that an electro-conductive layer having a film thickness of 15 μm was formed on the support.

Subsequently, 3 parts of N-methoxymethylated nylon and 3 parts of copolymerized nylon are dissolved in a mixed solvent of 65 parts of methanol and 30 parts of n-butanol, so as to prepare a coating liquid for forming an intermediate layer.

The coating liquid for forming an intermediate layer forming liquid was applied to the electro-conductive layer, and dried at 80° C. for 10 minutes, so that an intermediate layer having a film thickness of 0.7 μm was formed on the electro-conductive layer.

Subsequently, 10 parts of hydroxygallium phthalocyanine in a crystalline form having strong peaks at Bragg angles) (2θ±0.2° of 7.5°, 9.9°, 16.3°, 18.6°, 25.1° and 28.3° in CuKα characteristic X-ray diffraction were prepared as charge-generating substance, which was added to a solution of 5 parts of a polyvinyl butyral resin (brand name: S-LEC BX-1 made by Sekisui Chemical Co., Ltd.) dissolved in 250 parts of cyclohexane, so as to be dispersed under atmosphere at 23±3° C. for 1 hour with a sand mill using glass beads with a diameter of 1 mm. After dispersion, 250 parts of ethyl acetate was added for preparation of a coating liquid to form a charge generation layer.

The coating liquid to form a charge generation layer was applied to the intermediate layer by immersion coating. The produced coating was dried at 100° C. for 10 minutes. A charge generation layer with a film thickness of 0.26 μm was thus formed.

Subsequently, 9 parts of a compound (charge-transporting substance) represented by Formula (E-1), 1 part of a compound (charge-transporting substance) represented by Formula (E-2), 3 parts of a polyester resin A (a resin A(1) described in Table 1)), and a polyester resin C (containing a structural unit represented by Formula (C-1) and a structural unit represented by Formula (C-2) in a ratio of 5:5). 7 parts of a weight average molecular weight of 120,000) were dissolved in a mixed solvent of 20 parts of dimethoxymethane and 30 parts of ortho-xylene for preparation of a charge transport layer coating liquid. The charge transport layer coating liquid was applied to the charge-generating layer by immersion coating. The produced coating film was dried at 120° C. for 1 hour. A charge transport layer with a film thickness of 16 μm was thus formed. The formed charge transport layer was confirmed to have a small domain structure with a size of 1 μm or less which contains a polyester resin A in a matrix which contains the charge-transporting substance and the polyester resin C.

An electrophotographic photosensitive member A1 having a charge transport layer as the surface layer was thus manufactured.

<Evaluation of Matrix-Domain Structure>

The charge transport layer of the electrophotographic photosensitive member manufactured by the method was cut in the vertical direction of the charge transport layer to form a cross section, of which observation was performed with an ultra-high depth shape measurement microscope (trade name: VK-9500, made by Keyence Corporation), so as to confirm the presence or absence of matrix-domain structure. In this occasion, the maximum sizes of the randomly selected 100 domains formed in a visual field of 100 μm square (10,000 $\mu m^2$) on the surface of the electrophotographic photosensitive member are measured with an object lens magnification of 50. The average value was calculated from the obtained maximum sizes so as to obtain the number average particle size. The results are described in Table 8.

Manufacturing Examples A2 to A5

Electrophotographic photosensitive members A2 to A5 were manufactured for evaluation as in the manufacturing example A1 except for the change in the resin and charge-transporting substance of the charge transport layer to those described in Table 2. The formed charge transport layer was confirmed to contain a small domain with a size of 1 μm or less which includes a polyester resin A in a matrix which includes a charge-transporting substance and a polyester resin C. The results are described in Table 8. The weight average molecular weight of the polyester resin C described in Table 2 was as follows.

Polyester resin C ((C-1)/(C-2))=5/5): 120,000

Polyester resin C (C-3): 100,000

TABLE 2

| Electrophotographic photosensitive member | Charge-transporting substance | Polyester resin A | Polyester resin C |
|---|---|---|---|
| A1 | (E-1)/(E-2) = 9/1 | Resin A(1) | (C-1)/(C-2) = 5/5 |
| A2 | (E-1)/(E-2) = 9/1 | Resin A(5) | (C-1)/(C-2) = 5/5 |
| A3 | (E-1)/(E-2) = 9/1 | Resin A(6) | (C-1)/(C-2) = 5/5 |
| A4 | (E-1)/(E-2) = 9/1 | Resin A(8) | (C-1)/(C-2) = 5/5 |
| A5 | (E-1)/(E-2) = 9/1 | Resin A(9) | C-3 |

Manufacturing Examples A6 to A10

Electrophotographic photosensitive members A6 to A10 were manufactured for evaluation as in the manufacturing example A1 except for the change from the polyester resin C of the charge transport layer to polyester resin D, with use of those described in Table 3 as the polyester resin A and the polycarbonate resin D, respectively. The formed charge transport layer was confirmed to contain a small domain with a size of 1 μm or less which includes a polyester resin A in a matrix which includes a charge-transporting substance and the polyester resin D. The results are described in Table 8. The weight average molecular weight of the polyester resin D described in Table 3 was as follows.

polycarbonate resin D (D-1): 140,000

TABLE 3

| Electrophotographic photosensitive member | Charge-transporting substance | Polyester resin A | Polycarbonate resin D |
|---|---|---|---|
| A6 | (E-1)/(E-2) = 9/1 | Resin A(2) | D-1 |
| A7 | (E-1)/(E-2) = 9/1 | Resin A(3) | D-1 |
| A8 | (E-1)/(E-2) = 9/1 | Resin A(4) | D-1 |
| A9 | (E-1)/(E-2) = 9/1 | Resin A(5) | D-1 |
| A10 | (E-1)/(E-2) = 9/1 | Resin A(9) | D-1 |

Manufacturing Examples A11 to A14

Electrophotographic photosensitive members A11 to A14 were manufactured for evaluation as in the manufacturing example A1 except for the change from the charge-transporting substance, the polyester resin A and the polyester resin C of the charge transport layer to those described in Table 4, respectively, and the change of the mixed solvent for use in the coating liquid for forming the charge transport layer to 40 parts of tetrahydrofuran and 40 parts of toluene. In manufacturing examples A11 and A14, the polycarbonate resin D described in Table 4 was used instead of the polyester resin C. The formed charge transport layer was confirmed to contain a small domain with a size of 1 μm or less which includes the polyester resin A in a matrix which includes a charge-transporting substance and the polyester resin C or the polycarbonate resin D. The results are described in Table 8. The weight average molecular weight of the polyester resin C and the polycarbonate resin D described in Table 4 was as follows.

Polyester resin C (C-4): 100,000

Polycarbonate resin D (D-2): 130,000

Polycarbonate resin D (D-3): 160,000

TABLE 4

| Electrophotographic photosensitive member | Charge-transporting substance | Polyester resin A | Polyester resin C Polycarbonate resin D |
|---|---|---|---|
| A11 | E-3 | Resin A(5) | D-2 |
| A12 | E-3 | Resin A(7) | C-4 |
| A13 | E-4 | Resin A(5) | C-4 |
| A14 | E-4 | Resin A(7) | D-3 |

In Tables 2 to 4, "Charge-transporting substance" represents the charge-transporting substance contained in the charge transport layer in the manufacturing examples, indicating the kind of charge-transporting substances and a mixing ratio in the case of mixed use of charge-transporting substances. In Tables 2 to 4, "Polyester resin C/polycarbonate resin D" represents a structural unit represented by the Formulas (C-1) to (C-4), or (D-1) to (D-3) of the polyester resin C or the polycarbonate resin D for use in the manufacturing examples.

Manufacturing Examples A15 to A19

Electrophotographic photosensitive members A15 to A19 were manufactured for evaluation as in the manufacturing example A1 except for the change in the resin and the charge-transporting substance to those described in Table 5. The formed charge transport layer was confirmed to contain a small domain with a size of 1 μm or less which includes a polyester resin A in a matrix which includes the charge-transporting substance and the polyester resin C. The results are described in Table 8. The weight average molecular weight of the polyester resin C described in Table 5 was as follows.

Polyester carbonate resin C ((C-1)/(C-2)=5/5): 120,000

Polyester carbonate resin C ((C-1)/(C-3)=3/7): 100,000

TABLE 5

| Electrophotographic photosensitive member | Charge-transporting substance | Polyester resin A | Polyester resin C |
|---|---|---|---|
| A15 | (E-1)/(E-2) = 9/1 | Resin A(10) | (C-1)/(C-2) = 5/5 |
| A16 | (E-1)/(E-2) = 9/1 | Resin A(11) | (C-1)/(C-2) = 5/5 |
| A17 | (E-1)/(E-2) = 9/1 | Resin A(12) | (C-1)/(C-2) = 5/5 |
| A18 | (E-1)/(E-2) = 9/1 | Resin A(13) | (C-1)/(C-2) = 5/5 |
| A19 | (E-1)/(E-5) = 9/1 | Resin A(10) | (C-1)/(C-3) = 3/7 |

In Table 5, "Charge-transporting substance" represents the charge-transporting substance contained in the charge transport layer in the manufacturing examples, indicating the kind of charge-transporting substances and a mixing ratio in the case of mixed use of charge-transporting substances. In Table 5, "Polyester resin C" represents a structural unit represented by the Formulas (C−1) to (C-4) for use in the manufacturing examples.

<Synthesizing of Polyester Resin F>

A polyester resin F (resins F(1) and F(2)) was synthesized as described in the following Table 6. The polyester resin F includes the following structural unit represented by a Formula (F-1).

(F-1)

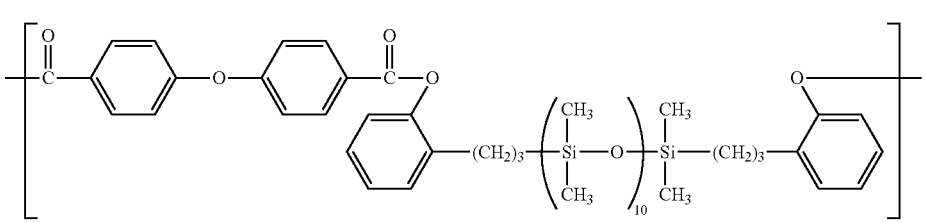

TABLE 6

| Polyester resin F | Formula (A) or (F) Structural unit | Formula (A) or (F) Average value of n | Formula (B) | Formula (C) | Content of Formula (A) or (F) | Content of Formula (B) | Weight average molecular weight |
|---|---|---|---|---|---|---|---|
| Resin F(1) | (F-1) | 10 | (B-3) | — | 20 | 80 | 130,000 |
| Resin F(2) | (A-5) | 40 | — | (C-3) | 20 | — | 110,000 |

In Table 6, "Formula (A) or (F)" represents the structural unit represented by the Formula (A) or (F). "Average value of n" represents the average value of n of the total structural units represented by the Formula (A) or (F) included in the polyester resin F. "Formula (B)" represents the structural unit represented by the Formula (B). "Formula (C)" represents the structural unit represented by the Formula (C). "Content of Formula (A)/(F)" represents the content (% by mass) of the structural unit represented by the Formula (A) or (F) in the polyester resin F. "Content of Formula (B)" represents the content (% by mass) of the structural unit represented by the Formula (B) in the polyester resin F.

Manufacturing Example A20

An electrophotographic photosensitive member A20 was manufactured for evaluation as in the manufacturing example A1 except for the change from the polyester resin A to a polyester resin F(1) as described in Table 7. The formed charge transport layer was not confirmed to contain a matrix-domain structure. Reduction in torque was confirmed. The results are described in Table 8.

Manufacturing Example A21

An electrophotographic photosensitive member A21 was manufactured for evaluation as in the manufacturing example A1 except for the change from the polyester resin A to a polyester resin F(2) as described in Table 7. The formed charge transport layer was confirmed to contain a small matrix-domain structure with a size of 1 μm or less. The evaluation was performed in the same way as in the manufacturing example A1. The results are described in Table 8.

TABLE 7

| Electrophotographic photosensitive member | Charge-transporting substance | Polyester resin F | Polyester resin C |
|---|---|---|---|
| A20 | (E-1)/(E-2) = 9/1 | Resin F(1) | (C-1)/(C-2) = 5/5 |
| A21 | (E-1)/(E-2) = 9/1 | Resin F(2) | (C-1)/(C-2) = 5/5 |

TABLE 8

| Electrophotographic photosensitive member | Presence or absence of matrix-domain structure | Presence or absence of structural unit represented by Formula (B) | Number average particle size of domain (nm) |
|---|---|---|---|
| A1 | Existence | Existence | 270 |
| A2 | Existence | Existence | 400 |
| A3 | Existence | Existence | 440 |
| A4 | Existence | Existence | 400 |
| A5 | Existence | Existence | 350 |
| A6 | Existence | Existence | 290 |
| A7 | Existence | Existence | 480 |
| A8 | Existence | Existence | 500 |
| A9 | Existence | Existence | 420 |
| A10 | Existence | Existence | 250 |
| A11 | Existence | Existence | 290 |
| A12 | Existence | Existence | 260 |
| A13 | Existence | Existence | 280 |
| A14 | Existence | Existence | 280 |
| A15 | Existence | Existence | 260 |
| A16 | Existence | Existence | 260 |
| A17 | Existence | Existence | 280 |
| A18 | Existence | Existence | 270 |
| A19 | Existence | Existence | 280 |
| A20 | Non-existence | Existence | — |
| A21 | Existence | Non-existence | 340 |

Manufacturing Examples B1 to B9 of Resin Particles

Manufacturing Example b1

An aqueous mixed liquid was prepared by adding 9 parts by mass of colloidal silica and 0.15 parts by mass of polyvinyl pyrrolidone as dispersion stabilizers to 4000 parts by mass of ion-exchange water. Subsequently, an oil-based mixed liquid including 50 parts by mass of acrylonitrile, 45 parts by mass of methacrylonitrile, and 5 parts by mass of methyl methacrylate as polymerizable monomers, 12.5 parts by mass of n-hexane as inclusion material, and 0.75 parts by mass of dicumyl peroxide as polymerization initiator was prepared. The oil-based mixed liquid was added to the aqueous mixed liquid, to which 0.4 parts by mass of sodium hydroxide was further added, so that a dispersion liquid was prepared.

The produced dispersion liquid was agitated and mixed for 3 minutes with a homogenizer. The dispersion liquid was then fed into a polymerization reaction container substituted with nitrogen and agitated at 200 rpm for a reaction at 60° C. for 20 hours, so that a reaction product was prepared. The produced reaction product was subjected to repeated filtration and water washing, and dried at 80° C. for 5 hours to make resin particles. The resin particles were crushed and classified with an acoustic classifier, so that resin particles b1 having an average particle size of 12 μm were obtained.

Manufacturing Example b2

Resin particles were manufactured by the same method as in the manufacturing example b1 except for the change of the added number of parts of colloidal silica to 4.5 parts by mass. The resin particles b2 having an average particle size of 50 μm were obtained by classification in the same way.

Manufacturing Example b3

Among particles classified into different particle sizes in manufacturing example b1, resin particles b3 have an average particle size of 18 μm.

Manufacturing Example b4

Among particles classified into different particle sizes in manufacturing example b1, resin particles b4 have an average particle size of 10 μm.

Manufacturing Example b5

Among particles classified into different particle sizes in manufacturing example b2, resin particles b5 have an average particle size of 40 μm.

Manufacturing Example b6

Resin particles were manufactured by the same method as in the manufacturing example b1 except for the change of the polymerizable monomers to 45 parts by mass of methacrylonitrile and 55 parts by mass of methyl acrylate, and classified into resin particles b6 having an average particle size of 25 μm.

Manufacturing Example b7

Resin particles were manufactured by the same method as in the manufacturing example b2 except for the change of the polymerizable monomers to 45 parts by mass of acrylamide and 55 parts by mass of methacrylamide, and classified into resin particles b7 having an average particle size of 45 μm.

Manufacturing Example b8

Resin particles were manufactured by the same method as in the manufacturing example b2 except for the change of the polymerizable monomers to 60 parts by mass of methyl methacrylate and 40 parts by mass of acrylamide, and classified into resin particles b8 having an average particle size of 10 μm.

Manufacturing Example b9

Resin particles were manufactured by the same method as in the manufacturing example b1 except for addition of quaternary ammonium perchlorate (ADEKA CIZER LV-70 made by Adeka Corporation) to the polymerizable monomers, and classified into resin particles b9 having an average particle size of 15 μm.

Manufacturing Examples c1 to c16 of Electro-Conductive Rubber Composition

Manufacturing Example c1

To 100 parts of acrylonitrile-butadiene rubber (NBR) (trade name: N230SV, made by JSR Corporation), the other 4 kinds of materials described in the field of components (1) in the following Table 9 were added, and the mixture was kneaded with an enclosed mixer adjusted to 50° C. for 15 minutes. To the kneaded mixture, 3 kinds of materials described in the field of component (2) in the Table 9 were added. Subsequently, the mixture was kneaded for 10 minutes with a two-roll mill cooled at 25° C., so as to make an electro-conductive rubber composition c1.

TABLE 9

| | Material | Part by mass |
|---|---|---|
| Component (1) | Acrylonitrile-butadiene rubber (NBR) (trade name: N230SV, made by JSR Corporation) | 100 |
| | Carbon black (trade name: TOKA BLACK #7360SB, made by Tokai Carbon Co., Ltd.) | 48 |
| | Zinc Stearate (trade name: SZ-2000, made by Sakai Chemical Industry Co., Ltd.) | 1 |
| | Zinc oxide (trade name: ZINC FLOWER-second type, made by Sakai Chemical Industry Co., Ltd.) | 5 |
| | Calcium carbonate (trade name: SILVER W, made by Shiraishi Kogyo) | 20 |
| Component (2) | Resin particles b1 | 12 |
| | Sulfur (vulcanizing agent) | 1.2 |
| | Tetrabenzylthiuram disulfide (TBzTD) (trade name: PERKACIT TBzTD, a vulcanization accelerator made by Flexsys) | 4.5 |

Manufacturing Example c2

An electro-conductive rubber composition c2 was manufactured by the same method as in the manufacturing example c1 except for the change from resin particles b1 to resin particles b2.

Manufacturing Examples c3 to c6

Electro-conductive rubber composition c3 to c6 were manufactured by the same method as in the manufacturing example c1 except for the change of the kind and the added number of parts of resin particles to those described in Table 11.

Manufacturing Example c7

To 100 parts of styrene-butadiene rubber (SBR) (trade name: SBR1500, made by JSR Corporation), the other 6 kinds of materials described in the field of components (1) in the following Table 10 were added, and the mixture was kneaded with a closed type mixer adjusted to 80° C. for 15 minutes. To the kneaded mixture, 3 kinds of materials described in the field of component (2) in the Table 10 were added. Subsequently, the mixture was kneaded for 10 minutes with a two-roll mill cooled at 25° C., so as to make an electro-conductive rubber composition c7.

TABLE 10

| | Material | Part by mass |
|---|---|---|
| Component (1) | Styrene-butadiene rubber (SBR) (trade name: SBR1500, made by JSR Corporation) | 100 |

TABLE 10-continued

| | Material | Part by mass |
|---|---|---|
| | Zinc Oxide (trade name: ZINC FLOWER-second type, made by Sakai Chemical Industry Co., Ltd.) | 5 |
| | Zinc Stearate (trade name: SZ-2000, made by Sakai Chemical Industry Co., Ltd.) | 2 |
| | Carbon black (trade name: KETJEN BLACK EC600JD, made by Lion Corporation) | 8 |
| | Carbon black (trade name: SEAST S, made by Tokai Carbon Co., Ltd.) | 40 |
| | Calcium carbonate (trade name: SILVER W, made by Shiraishi Kogyo) | 15 |
| | Paraffin oil (trade name: PW380, made by Idemitsu Kosan Co., Ltd.) | 20 |
| Component (2) | Resin particles b5 | 20 |
| | Sulfur (vulcanizing agent) | 1 |
| | Dibenzothiazil sulfide (DM) (trade name: NOCCELER DM, a vulcanization accelerator made by Ouchi Shinko Chemical Industrial Co., Ltd. | 1 |

Manufacturing Examples c8 to c13

Electro-conductive rubber compositions c8 to c13 were manufactured by the same method as in the manufacturing example c1 except for the change of the kind and the added number of parts of resin particles to those described in Table 11.

Manufacturing Example c14

In the manufacturing example c1, acrylonitrile-butadiene rubber was changed to butadiene rubber (BR) (trade name: JSR BR01 made by JSR Corporation), the parts by mass of carbon black was changed to 30, and the resin particles b1 were changed to resin particles 8 (5 parts by mass). Electro-conductive rubber composition c14 was manufactured by the same method as in the manufacturing example c1 except for the above.

Manufacturing Example c15

Electro-conductive rubber composition c15 was manufactured by the same method as in the manufacturing example c1 except for the change from the resin particles b1 to the resin particles 9.

Manufacturing Example c16

The following components were added to 100 parts by mass of epichlorohydrin rubber (EO-EP-AGE ternary compound, EO/EP/AGE=73 mol %/23 mol %/4 mol %), and kneaded in an enclosed mixer adjusted to 50° C. for 10 minutes so as to prepare a raw material compound.

Calcium carbonate (trade name: SILVER W, made by Shiraishi Kogyo): 80 parts by mass;

Adipic acid ester (trade name: Polycizer W305ELS, made by DIC Corporation): 8 parts by mass;

Zinc Stearate (trade name: SZ-2000, made by Sakai Chemical Industry Co., Ltd.): 1 part by mass;

2-Mercaptobenzimidazole (MB) (anti-ageing agent): 0.5 parts by mass;

Zinc oxide (trade name: ZINC FLOWER-second type, made by Sakai Chemical Industry Co., Ltd.): 2 parts by mass;

Quaternary ammonium salt (trade name: ADEKA CIZER LV-70 made by Adeka Corporation): 2 parts by mass;

Carbon black (trade name: THERMAX FLOFORM N990, made by Cancarb Limited in Canada, average particle size: 270 nm): 5 parts by mass;

To the above, 0.8 parts by mass of sulfur as vulcanizing agent, and 1 part by mass of dibenzothiazil sulfide (DM) and 0.5 parts by mass of tetramethylthiuram monosulfide (TS) as vulcanization accelerators were added. Subsequently, the mixture was kneaded for 10 minutes with a two-roll mill cooled at 20° C., so as to make an electro-conductive rubber composition c16. On this occasion, the gap between the two rolls was adjusted to 1.5 mm.

TABLE 11

| | | Resin particles | | | |
|---|---|---|---|---|---|
| Electro-conductive rubber composition | Binder Rubber | Resin particle | Material | Particle size (μm) | Part by mass |
| c1 | NBR | b1 | Acrylonitrile-methacrylonitrile-methyl methacrylate | 12 | 12 |
| c2 | NBR | b2 | Acrylonitrile-methacrylonitrile-methyl methacrylate | 50 | 12 |
| c3 | NBR | b1 | Acrylonitrile-methacrylonitrile-methyl methacrylate | 12 | 10 |
| c4 | NBR | b3 | Acrylonitrile-methacrylonitrile-methyl methacrylate | 18 | 8 |
| c5 | NBR | b4 | Acrylonitrile-methacrylonitrile-methyl methacrylate | 10 | 5 |
| c6 | NBR | b5 | Acrylonitrile-methacrylonitrile-methyl methacrylate | 40 | 10 |
| c7 | SBR | b5 | Acrylonitrile-methacrylonitrile-methyl methacrylate | 40 | 20 |
| c8 | NBR | b6 | Methacrylonitrile-methyl acrylate | 25 | 8 |
| c9 | NBR | b6 | Methacrylonitrile-methyl acrylate | 25 | 12 |
| c10 | NBR | b6 | Methacrylonitrile-methyl acrylate | 25 | 15 |
| c11 | NBR | b6 | Methacrylonitrile-methyl acrylate | 25 | 18 |
| c12 | NBR | b6 | Methacrylonitrile-methyl acrylate | 25 | 20 |

TABLE 11-continued

| Electro-conductive rubber composition | Binder Rubber | Resin particles: Resin particle | Material | Particle size (μm) | Part by mass |
|---|---|---|---|---|---|
| c13 | NBR | b7 | Acrylamide-methacrylamide | 45 | 12 |
| c14 | BR | b8 | Methyl methacrylate-acrylamide | 10 | 5 |
| c15 | NBR | b9 | Acrylonitrile-methacrylonitrile-methyl methacrylate-quaternary ammonium perchlorate | 15 | 12 |
| c16 | Hydrine | — | — | — | — |

<Evaluation Method of Charging Member and Resin Particles>

[1. Electrical Resistivity of Charging Member]

Figure 5:
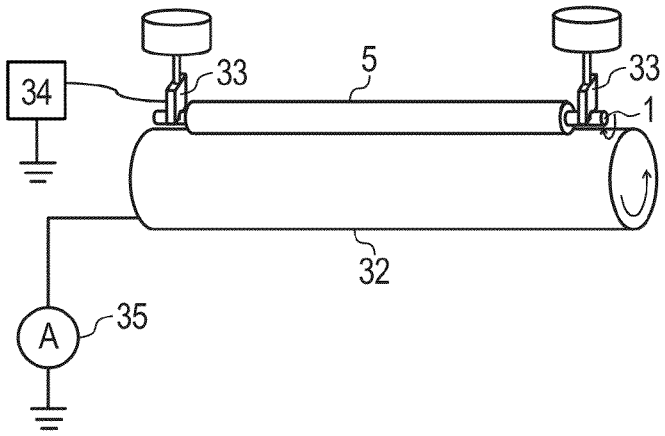
FIG. 5 is a view illustrating an apparatus for measuring electrical resistivity of a charging roller.

FIG. 5 is a view illustrating an apparatus for measuring electrical resistivity of a charging roller. A load is applied to both ends of the electro-conductive substrate 1 through a bearing 33, such that the charging roller 5 is contacted, in parallel, with a cylindrical metal 32 having the same curvature as that of the electrophotographic photosensitive member. The cylindrical metal 32 is rotated with a motor (not shown in the drawing) in this state, so that a DC voltage of −200 V is applied to the contacted rotation-driven charging roller 5 from a stabilized power source 34. On this occasion, the flowing current is measured with an ammeter 35 for calculation of the electrical resistivity of the charging roller. Each of the load is set to 4.9 N. The metal cylinder has a diameter of 30 mm. The metal cylinder is rotated at a circumferential velocity of 45 mm/sec.

Prior to the measurement, the charging roller is left standing in an environment at a temperature of 23° C. and a relative humidity of 50% for 24 hours or more. The measurement is performed with a measurement apparatus kept under the same environment.

[2. Measurement of Surface Roughness Rzjis and Average Irregularity Spacing RSm of Charging Member]

Using a surface roughness measurement apparatus (trade name: SE-3500, made by Kosaka Laboratory Ltd.), measurement was performed based on Japanese Industrial Standard (JIS) B 0601-1994. The Rzjis is an average value of measurement values at randomly selected 6 sites on the charging member. The Sm is calculated by measuring 10 irregularity spacings for each of the 6 sites randomly selected so as to obtain the average value, and calculating the average value of "the averages for the 6 sites each". In the measurement, the cut off value is 0.8 mm, and the evaluation length is 8 mm.

[3. Shape Measurement of Bowl-Shaped Resin Particle]

Over a span of 500 μm of an arbitrary point of the electro-conductive elastic layer, 10 pieces are cut out at total 5 points including at the central part in the longitudinal direction of the roller, at the positions each 45 mm away from the central part toward both ends, and at the positions each 90 mm away from the central part toward both ends, at phases of 0° and 180° in the roller circumferential direction, respectively, for photographing the cross-sectional images, by using a focused ion beam processing and observation system (trade name: FB-2000C, made by Hitachi, Ltd.) at a step of 20 nm. The obtained cross-sectional images are combined to calculate the stereoscopic image of the bowl-shaped resin particles. From the stereoscopic image, the maximum diameter 58 illustrated in FIG. 3 and the minimum diameter 74 of the opening illustrated in FIGS. 4A to 4E are calculated. Also from the stereoscopic image, the difference between the outer diameter and the inner diameter at arbitrary 5 points of the bowl-shaped resin particles are calculated. The measurement is performed for 10 resin particles in the visual field. The average values of the total 100 measured values are calculated to obtain the "maximum diameter", the "minimum diameter of opening" and the "difference between outer diameter and inner diameter", respectively.

[4. Measurement of Difference in Height Between the Apex of the Protrusion and the Bottom of Concavity in the Surface of Charging Member]

The surface of a charging member is observed in a visual field of 0.5 mm long and 0.5 mm wide using a laser microscope (trade name: LXM5 PASCAL, made by Carl Zeiss AG). A laser beam is scanned in the XY-plane in the visual field so as to obtain a two-dimensional image data. The focus point is then shifted in the Z-direction for repeating the scanning so as to obtain a three-dimensional image data. As a result, the presence of a concavity derived from the opening of the bowl-shaped resin particles and a protrusion derived from the opening edge of the bowl-shaped resin particles are first confirmed. Further, the difference in height 57 between the apex 55 of a protrusion 54 and the bottom 56 of concavity is calculated. The operation is performed for 2 bowl-shaped resin particles in the visual field. The similar measurement is performed for 50 sites in the longitudinal direction of a charging member so as to obtain the total 100 measurement values, from which an average value is calculated as "difference in height".

[5. Measurement Method of Average Particle Size of Resin Particles]

The measurement for resin particle powder is performed with a Coulter counter multisizer. More specifically, 0.1 to 5 ml of a surfactant (alkyl benzene sulfonate) is added to 100 to 150 ml of an electrolyte solution, into which 2 to 20 mg of resin particles are added. The electrolyte solution with suspended resin particles is subjected to dispersion processing for 1 to 3 minutes with an ultrasonic disperser for the measurement of particle size distribution based on volume, by using a Coulter counter multisizer with a 100 μm aperture. From the obtained particle size distribution, the volume average particle size is obtained by computer processing as average particle size of the resin particles.

Manufacturing Example of Charging Roller

Manufacturing Example T1

1. Preparation of Electro-Conductive Substrate

A round bar of stainless steel with a diameter of mm and a length of 252.5 mm was applied with a thermosetting adhesive containing 10% by mass of carbon black, which was dried to prepare an electro-conductive substrate.

2. Preparation of Charging Roller

Figure 7:
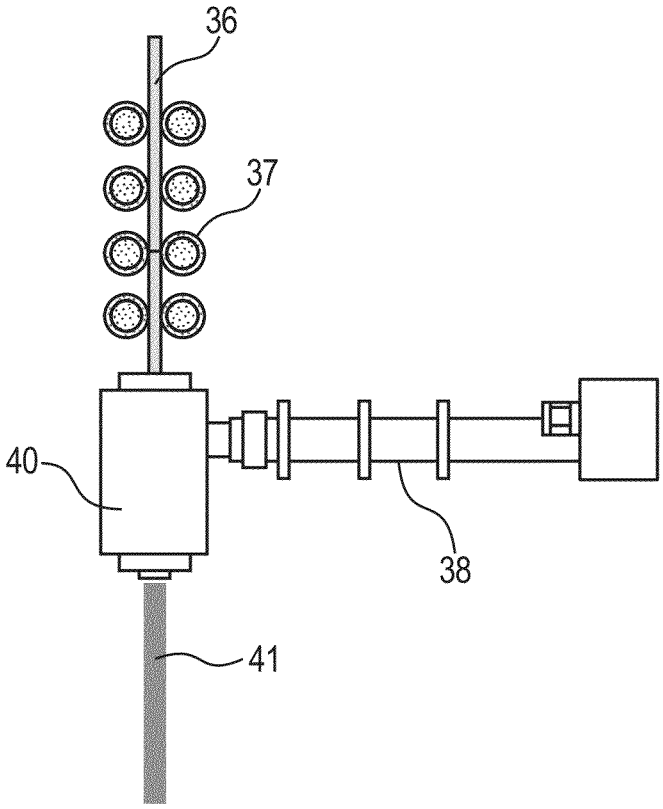
FIG. 7 is a cross-sectional view illustrating a cross-head extruder for use in manufacturing a charging roller.

Using an extruder having a crosshead illustrated in FIG. 7, a rubber roller having an electro-conductive substrate as central axis and the outer periphery thereof coated with an electro-conductive rubber composition c1 in a coaxial cylindrical form was obtained. The thickness of the coating rubber composition is adjusted to 1 mm. In FIG. 7, an electro-conductive substrate 36, a feed roller 37, an extruder 38, a crosshead 40, and roller 41 after extrusion are illustrated.

The roller was heated in a hot-air oven at 160° C. for 1 hour, and both ends of the rubber composition layer were removed so that the length was set to 224.2 mm. The roller was further subjected to a secondary heating at 160° C. for 1 hour, so that a roller having an electro-conductive elastic layer of a rubber composition with a thickness of 2 mm was prepared.

The outer circumferential surface of the produced roller was ground with a plunge cutting-type cylindrical grinding machine. A vitrified grinding stone was used as grinding stone. Abrasive grains for use was green silicon carbide (GC) with a particle size of 100 mesh. The rotation speed of the roller was set to 350 rpm. The rotation speed of the grinding stone was set to 2050 rpm. The rotation direction of the roller and the rotation direction of the grinding stone were in the same direction (driven direction). An elastic roller e1 was prepared by grinding with an infeed rate set to 20 mm/minute and a spark-out time (time for an infeed of 0 mm) set to 0 second. The thickness of the electro-conductive elastic layer is adjusted to 1.5 mm. The roller had a crown amount of 150 μm.

The surface of the obtained elastic roller e1 was processed with electron beam irradiation under the following conditions, so that a charging roller T1 was obtained. For electron beam irradiation, an electron beam irradiation apparatus (made by Iwasaki Electric Co., Ltd.) having a maximum acceleration voltage of 150 kV and a maximum electronic current of 40 mA was used. Prior to electron beam irradiation, air in the irradiation chamber of the electron beam irradiation apparatus was purged with nitrogen gas. The processing conditions included an acceleration voltage of 80 kV, an electronic current of 20 mA, a processing speed of 2.04 m/minute, and an oxygen concentration of 100 ppm. The apparatus constant of the electron beam irradiation apparatus is 20.4 at an acceleration voltage 80 kV. The dose calculated from the expression (1) is 200 kGy. The evaluation results are described in Table 13.

The surface of the electro-conductive elastic roller had protrusions derived from the opening edge of the bowl-shaped resin particle and concavitys derived from the opening of the bowl-shaped resin particles. The electro-conductive elastic roller was defined as a charging roller T1. The evaluation results are described in Table 13.

Manufacturing Examples T2 to T14

Charging rollers T2 to T15 were manufactured by the same method as in the manufacturing example T1 except for the change of the kind of the electro-conductive composition and grinding conditions to those described in Table 12. The charging rollers had an electro-conductive elastic layer including protrusions derived from the opening edge of the bowl-shaped resin particles and concavitys derived from the opening of the bowl-shaped resin particles. The evaluation results are described in Table 13.

Manufacturing Examples T15 and T16

Charging rollers T15 and T16 were manufactured by the same method as in the manufacturing example T1 except for the change of the electron beam irradiation processing conditions to those described in Table 12. The evaluation results are described in Table 13.

Manufacturing Example T17

Charging roller T17 was manufactured by the same method as in the manufacturing example T1 except for the change of the kind of the electro-conductive rubber composition to those described in Table 12. The evaluation results are described in Table 13.

Manufacturing Example T18

An elastic roller e16 was manufactured by the same method as in the manufacturing example T1 except for the change of the kind of the electro-conductive rubber composition and the grinding conditions to those described in Table 12. The elastic roller e16 had no protrusions due to the bowl-shaped resin particles in the roller surface.

Subsequently, a coating liquid for forming the electro-conductive surface layer was prepared by the following method.

Methyl isobutyl ketone was added to a caprolactone modified acrylic polyol solution (trade name: PLACCEL DC2016, made by Daicel Corporation), which was adjusted to have a solid content of 11% by mass. The following components were added to 714 parts by mass of the solution (acrylic polyol solid content: 100 parts by mass), so that a mixed solution was prepared.

Carbon black (trade name: #52, made by Mitsubishi Chemical Corporation): 25 parts by mass;

Surface-processed titanium oxide particles (prepared in the manufacturing example B2): 25 parts by mass;

Modified dimethyl silicone oil (*1): 0.08 parts by mass;

Blocked isocyanate mixture (*2): 80.14 parts by mass.

On this occasion, the blocked isocyanate mixture had an isocyanate content of "NCO/OH=1.0".

(*1) Modified dimethyl silicone oil (trade name: SH28PA, made by Dow Corning Toray Silicone Co., Ltd.

(*2) A mixture of butanone oxime blocks of hexamethylene diisocyanate (HDI) and isophorone diisocyanate (IPDI) each with a ratio of 7:3.

Into a glass bottle having a capacity of 450 mL, 187 g of the mixed solution was added together with 200 g of glass beads having an average particle size of 0.8 mm as media. The mixture was dispersed for 48 hours with a paint shaker disperser. After dispersion, 8.25 g of cross-linked polymethyl methacrylate resin particles (trade name: MBX-30, made by Sekisui Plastics Co., Ltd.) was added. (The equivalent amount of the resin particles was 50 parts by mass based on 100 parts by mass of the acrylic polyol solid content.) The mixture was then dispersed for 5 minutes, and the glass beads were removed so as to prepare a coating liquid for forming the electro-conductive surface layer.

An elastic roller e16 was prepared by a dipping coating method including immersing the roller with the longitudinal axis in vertical direction in the coating liquid. The immersion time was 9 seconds. The lifting speed was initially 20 mm/second and finally 2 mm/second, being linearly changed with time. The produced coated product was air-dried at 23° C. for 30 minutes, then dried at 100° C. for 1 hour with a hot air circulation drying oven, and further dried at 160° C. for 1 hour, for curing of the coating film. As a result, a charging roller T18 was produced including the outer circumference of the electro-conductive substrate, on which the elastic layer and the surface layer were formed in this order. The surface layer had a film thickness of 5.2 μm. The film thickness of the surface layer was measured at a site having no resin particles. The evaluation results are described in Table 13.

Examples 1 to 70 and Comparative Examples 1 to 4

Example 1

An HP COLOR LASERJET ENTERPRISE CP4525n made by Hewlett-Packard Development Company (to which a cylindrical electrophotographic photosensitive member having a diameter of 24 mm can be installed), i.e. an electrophotographic image forming apparatus having a structure illustrated in FIG. 6, was modified to have a high processing speed of 330 mm/sec for use as evaluation apparatus. Installation of a high voltage power supply, and proper adjustment of motor gears and paper feeding were performed for the modification. The spring of the process cartridge was changed such that a charging roller having an outer diameter of 9 mm can be mounted and a pressing force of 2.45 N (0.25 kgf) can be applied to one end and a pressing force of 4.9 N (0.5 kgf) can be applied to both ends. The fixing position of a development blade was changed and a spacer was inserted between the development blade and a process cartridge container, so that the supported amount of toner on a development roller was adjusted to 0.50 mg/cm$^2$.

The manufactured electrophotographic photosensitive member A1 and the charging roller T1 were installed on the process cartridge and left standing in an environment at a temperature of 23° C. and a relative humidity of 50% for 24 hours or more. Subsequently the process cartridge was left standing in an environment at a temperature of 28° C. and a relative humidity of 80% for 10 minutes, and then subjected to image evaluation.

More specifically, a half tone image (image drawn by horizontal lines having a width of 1 dot and a space of 2 dots in the direction vertical to the rotation direction of the photosensitive member) was outputted for evaluation. The evaluation was performed by visual observation of the half tone image. The presence or absence of striped image defects in the electrophotographic image caused by charging was determined according to the following criteria:

Banding rank 1: no horizontal striped image occurs;

Banding rank 2: horizontal striped images are recognized for extremely thin concentration;

Banding rank 3: horizontal striped images are slightly recognized;

Banding rank 4: occurrence of horizontal striped images corresponding to the rotation pitch of a charging roller is recognized;

Banding rank 5: horizontal striped images are distinguished (many horizontal striped images occur irrespective of the rotation pitch of a charging roller).

With a combination of the electrophotographic photosensitive member and the charging roller in the present Examples, good images are produced without occurrence of horizontal striped image defects. The evaluation results are described in Table 14.

Examples 2 to 40

The evaluation was performed in the same way as in Example 1 except for the change in combination of the electrophotographic photosensitive member and the charging roller to those described in Table 14. The evaluation results are described in Table 14.

Examples 41 to 70

The evaluation was performed in the same way as in Example 1 except for the change in combination of the electrophotographic photosensitive member and the charging roller to those described in Table 15. The evaluation results are described in Table 15.

Comparative Examples 1 to 4

The evaluation was performed in the same way as in Example 1 except for the change in combination of the electrophotographic photosensitive member and the charging roller to those described in Table 15. The evaluation results are described in Table 15. In any of the Comparative Examples, horizontal striped image defects were distinguished.

TABLE 12

| | | Electro-conductive | Grinding condition | | Electron beam irradiation condition | | | | |
|---|---|---|---|---|---|---|---|---|---|
| Charging roller | Elastic roller | rubber composition | Infeed rate (mm/min) | Spark-out (sec) | Acceleration voltage (kV) | Electronic current (mA) | Processing rate (m/min) | Apparatus constant | Dose (kGy) |
| T1 | e1 | c1 | 20 | 0 | 80 | 20 | 2.04 | 20.4 | 200 |
| T2 | e2 | c2 | 20 | 0 | 80 | 20 | 2.04 | 20.4 | 200 |
| T3 | e3 | c3 | 20 | 0 | 80 | 20 | 2.04 | 20.4 | 200 |
| T4 | e4 | c4 | 20 | 0 | 80 | 20 | 2.04 | 20.4 | 200 |
| T5 | e5 | c5 | 20 | 0 | 80 | 20 | 2.04 | 20.4 | 200 |
| T6 | e6 | c6 | 20 | 0 | 80 | 20 | 2.04 | 20.4 | 200 |
| T7 | e7 | c7 | 30 | 0 | 80 | 20 | 2.04 | 20.4 | 200 |
| T8 | e8 | c8 | 20 | 0 | 80 | 20 | 2.04 | 20.4 | 200 |
| T9 | e9 | c9 | 20 | 0 | 80 | 20 | 2.04 | 20.4 | 200 |
| T10 | e10 | c10 | 20 | 0 | 80 | 20 | 2.04 | 20.4 | 200 |
| T11 | e11 | c11 | 20 | 0 | 80 | 20 | 2.04 | 20.4 | 200 |
| T12 | e12 | c12 | 20 | 0 | 80 | 20 | 2.04 | 20.4 | 200 |
| T13 | e13 | c13 | 10 | 1 | 80 | 20 | 2.04 | 20.4 | 200 |
| T14 | e14 | c14 | 20 | 0 | 80 | 20 | 2.04 | 20.4 | 200 |
| T15 | e1 | c1 | 20 | 0 | 125 | 35 | 2.54 | 36.2 | 500 |
| T16 | e1 | c1 | 20 | 0 | 150 | 20 | 1.51 | 37.8 | 1000 |
| T17 | e15 | c15 | 20 | 0 | 80 | 20 | 2.04 | 20.4 | 200 |
| T18 | e16 | c16 | 20 | 0 | — | — | — | — | — |

TABLE 13

| No. | Electric resistance (Ω) | Surface roughness (mm) Rzjis | Surface roughness (mm) Sm | Shape measurement (μm) Maximum diameter | Shape measurement (μm) Minimum diameter of opening | Shape measurement (μm) Difference between outer diameter and inner diameter | Irregularities (μm) Difference in height | Irregularities (μm) (Maximum diameter)/(Difference in height) | Irregularities (μm) (Maximum diameter)/(Minimum diameter of opening) |
|---|---|---|---|---|---|---|---|---|---|
| Charging roller T1 | 2.15E+05 | 35 | 80 | 50 | 32 | 0.5 | 38 | 1.32 | 1.56 |
| Charging roller T2 | 4.55E+05 | 52 | 100 | 100 | 60 | 0.8 | 63 | 1.59 | 1.67 |
| Charging roller T3 | 4.85E+05 | 35 | 97 | 50 | 28 | 0.3 | 38 | 1.32 | 1.79 |
| Charging roller T4 | 2.36E+05 | 21 | 101 | 35 | 15 | 0.5 | 27 | 1.30 | 2.33 |
| Charging roller T5 | 3.78E+05 | 12 | 100 | 17 | 13 | 0.1 | 20 | 0.85 | 1.31 |
| Charging roller T6 | 5.02E+05 | 48 | 120 | 89 | 65 | 0.3 | 50 | 1.78 | 1.37 |
| Charging roller T7 | 2.80E+06 | 48 | 55 | 86 | 45 | 0.5 | 57 | 1.51 | 1.91 |
| Charging roller T8 | 3.58E+05 | 30 | 170 | 53 | 35 | 0.4 | 40 | 1.33 | 1.51 |
| Charging roller T9 | 5.02E+05 | 31 | 130 | 53 | 32 | 0.4 | 40 | 1.33 | 1.66 |
| Charging roller T10 | 5.82E+05 | 30 | 100 | 53 | 26 | 0.4 | 40 | 1.33 | 2.04 |
| Charging roller T11 | 3.95E+05 | 28 | 60 | 53 | 31 | 0.4 | 40 | 1.33 | 1.71 |
| Charging roller T12 | 6.25E+05 | 31 | 40 | 53 | 32 | 0.4 | 40 | 1.33 | 1.66 |
| Charging roller T13 | 1.89E+05 | 48 | 150 | 90 | 45 | 2.9 | 51 | 1.76 | 2.00 |
| Charging roller T14 | 1.11E+06 | 11 | 130 | 20 | 12 | 2.8 | 13 | 1.54 | 1.67 |
| Charging roller T15 | 1.99E+05 | 35 | 80 | 50 | 32 | 0.5 | 38 | 1.32 | 1.56 |
| Charging roller T16 | 1.75E+05 | 35 | 80 | 50 | 32 | 0.5 | 38 | 1.32 | 1.56 |
| Charging roller T17 | 2.01E+05 | 19 | 80 | 33 | 15 | 0.5 | 23 | 1.43 | 2.20 |
| Charging roller T18 | 5.26E+06 | 23 | 80 | — | — | — | — | — | — |

25

TABLE 14

| | Electrophotographic photosensitive member | Charging roller | Banding rank |
|---|---|---|---|
| Example 1 | Electrophotographic photosensitive member A1 | Charging roller T1 | 1 |
| Example 2 | Electrophotographic photosensitive member A1 | Charging roller T2 | 2 |
| Example 3 | Electrophotographic photosensitive member A1 | Charging roller T3 | 1 |
| Example 4 | Electrophotographic photosensitive member A1 | Charging roller T4 | 1 |
| Example 5 | Electrophotographic photosensitive member A1 | Charging roller T5 | 1 |
| Example 6 | Electrophotographic photosensitive member A1 | Charging roller T6 | 1 |
| Example 7 | Electrophotographic photosensitive member A1 | Charging roller T7 | 1 |
| Example 8 | Electrophotographic photosensitive member A1 | Charging roller T8 | 2 |
| Example 9 | Electrophotographic photosensitive member A1 | Charging roller T9 | 2 |
| Example 10 | Electrophotographic photosensitive member A1 | Charging roller T10 | 2 |
| Example 11 | Electrophotographic photosensitive member A1 | Charging roller T11 | 1 |
| Example 12 | Electrophotographic photosensitive member A1 | Charging roller T12 | 1 |
| Example 13 | Electrophotographic photosensitive member A1 | Charging roller T13 | 2 |
| Example 14 | Electrophotographic photosensitive member A1 | Charging roller T14 | 3 |
| Example 15 | Electrophotographic photosensitive member A1 | Charging roller T15 | 1 |
| Example 16 | Electrophotographic photosensitive member A1 | Charging roller T16 | 1 |
| Example 17 | Electrophotographic photosensitive member A2 | Charging roller T8 | 1 |
| Example 18 | Electrophotographic photosensitive member A2 | Charging roller T10 | 1 |
| Example 19 | Electrophotographic photosensitive member A2 | Charging roller T12 | 1 |
| Example 20 | Electrophotographic photosensitive member A3 | Charging roller T8 | 3 |
| Example 21 | Electrophotographic photosensitive member A3 | Charging roller T10 | 2 |
| Example 22 | Electrophotographic photosensitive member A3 | Charging roller T12 | 1 |
| Example 23 | Electrophotographic photosensitive member A4 | Charging roller T8 | 3 |
| Example 24 | Electrophotographic photosensitive member A4 | Charging roller T10 | 3 |
| Example 25 | Electrophotographic photosensitive member A4 | Charging roller T12 | 1 |
| Example 26 | Electrophotographic photosensitive member A5 | Charging roller T8 | 3 |
| Example 27 | Electrophotographic photosensitive member A5 | Charging roller T10 | 1 |
| Example 28 | Electrophotographic photosensitive member A5 | Charging roller T12 | 1 |
| Example 29 | Electrophotographic photosensitive member A6 | Charging roller T8 | 2 |
| Example 30 | Electrophotographic photosensitive member A6 | Charging roller T10 | 1 |
| Example 31 | Electrophotographic photosensitive member A6 | Charging roller T12 | 1 |
| Example 32 | Electrophotographic photosensitive member A7 | Charging roller T8 | 2 |
| Example 33 | Electrophotographic photosensitive member A7 | Charging roller T10 | 1 |
| Example 34 | Electrophotographic photosensitive member A7 | Charging roller T12 | 1 |
| Example 35 | Electrophotographic photosensitive member A8 | Charging roller T8 | 3 |
| Example 36 | Electrophotographic photosensitive member A8 | Charging roller T10 | 1 |
| Example 37 | Electrophotographic photosensitive member A8 | Charging roller T12 | 1 |
| Example 38 | Electrophotographic photosensitive member A9 | Charging roller T8 | 1 |
| Example 39 | Electrophotographic photosensitive member A9 | Charging roller T10 | 1 |
| Example 40 | Electrophotographic photosensitive member A9 | Charging roller T12 | 1 |

TABLE 15

| | Electrophotographic photosensitive member | Charging roller | Banding rank |
|---|---|---|---|
| Example 41 | Electrophotographic photosensitive member A10 | Charging roller T8 | 2 |
| Example 42 | Electrophotographic photosensitive member A10 | Charging roller T10 | 2 |
| Example 43 | Electrophotographic photosensitive member A10 | Charging roller T12 | 1 |
| Example 44 | Electrophotographic photosensitive member A11 | Charging roller T8 | 1 |
| Example 45 | Electrophotographic photosensitive member A11 | Charging roller T10 | 1 |
| Example 46 | Electrophotographic photosensitive member A11 | Charging roller T12 | 1 |
| Example 47 | Electrophotographic photosensitive member A12 | Charging roller T8 | 3 |
| Example 48 | Electrophotographic photosensitive member A12 | Charging roller T10 | 2 |
| Example 49 | Electrophotographic photosensitive member A12 | Charging roller T12 | 1 |
| Example 50 | Electrophotographic photosensitive member A13 | Charging roller T8 | 1 |
| Example 51 | Electrophotographic photosensitive member A13 | Charging roller T10 | 1 |
| Example 52 | Electrophotographic photosensitive member A13 | Charging roller T12 | 1 |
| Example 53 | Electrophotographic photosensitive member A14 | Charging roller T8 | 2 |
| Example 54 | Electrophotographic photosensitive member A14 | Charging roller T10 | 1 |
| Example 55 | Electrophotographic photosensitive member A14 | Charging roller T12 | 1 |
| Example 56 | Electrophotographic photosensitive member A15 | Charging roller T8 | 1 |
| Example 57 | Electrophotographic photosensitive member A15 | Charging roller T10 | 1 |
| Example 58 | Electrophotographic photosensitive member A15 | Charging roller T12 | 1 |
| Example 59 | Electrophotographic photosensitive member A16 | Charging roller T8 | 2 |
| Example 60 | Electrophotographic photosensitive member A16 | Charging roller T10 | 1 |
| Example 61 | Electrophotographic photosensitive member A16 | Charging roller T12 | 1 |
| Example 62 | Electrophotographic photosensitive member A17 | Charging roller T8 | 1 |
| Example 63 | Electrophotographic photosensitive member A17 | Charging roller T10 | 1 |
| Example 64 | Electrophotographic photosensitive member A17 | Charging roller T12 | 1 |
| Example 65 | Electrophotographic photosensitive member A18 | Charging roller T8 | 1 |
| Example 66 | Electrophotographic photosensitive member A18 | Charging roller T10 | 1 |
| Example 67 | Electrophotographic photosensitive member A18 | Charging roller T12 | 1 |
| Example 68 | Electrophotographic photosensitive member A19 | Charging roller T8 | 1 |
| Example 69 | Electrophotographic photosensitive member A19 | Charging roller T10 | 1 |
| Example 70 | Electrophotographic photosensitive member A19 | Charging roller T12 | 1 |
| Comparative Example 1 | Electrophotographic photosensitive member A1 | Charging roller T17 | 4 |
| Comparative Example 2 | Electrophotographic photosensitive member A1 | Charging roller T18 | 5 |
| Comparative Example 3 | Electrophotographic photosensitive member A20 | Charging roller T14 | 4 |
| Comparative Example 4 | Electrophotographic photosensitive member A21 | Charging roller T14 | 5 |

In Comparative Example 1, quaternary ammonium perchlorate having ionic conductivity was added to the resin to form bowl-shaped resin particles. It is therefore presumed that the protrusions of the bowl-shaped resin particles in contact with the electrophotographic photosensitive member have insufficient insulation, incapable of maintaining a charged-up state. It is presumed that due to the resultant insufficient attraction between the protrusions and the electrophotographic photosensitive member, the occurrence of banding images was not properly prevented in Comparative Example 1.

In Comparative Example 2, it is presumed that due to the protrusion roughness formed on the surface of the charging member, the contact area with the electrophotographic photosensitive member is restricted in the same way as in Examples. However, none of the protrusions with exposure of bowl-shaped resin particles as in Examples is formed. Consequently, at the contact part between the electrophotographic photosensitive member and the charging member, gripping due to the bowl shape and sufficient electrostatic attraction between the charging member and the electrophotographic photosensitive member are not produced. It is presumed that the banding images in Comparative Example 2 were thereby produced.

In Comparative Example 3, it is presumed that no formation of the matrix-domain structure in the charge transport layer of the electrophotographic photosensitive member resulted in absence of a portion with a high content of structural unit represented by Formula (B) having a strong polar group, so that the effect for preventing occurrence of banding images was reduced.

In Comparative Example 4, it is presumed that absence of the structural unit represented by Formula (B) having a strong polar group contained in the charge transport layer resulted in insufficient attraction to the electrophotographic photosensitive member, so that the banding images occurred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-066587, filed Mar. 27, 2014 which is hereby incorporated by reference herein in its entirety.

What is claimed is:

1. An electrophoto graphic image forming apparatus comprising:

an electrophotographic photosensitive member, a charging unit in contact with the electrophotographic photosensitive member so as to charge the electrophotographic photosensitive member with a charging member, and a developing unit which supplies toner to the electrophotographic photosensitive member on which an electrostatic latent image is formed, to form a toner image on the electrophotographic photosensitive member;

wherein, the electrophotographic photosensitive member comprises:

a support, a charge generation layer disposed on the support, and a charge transport layer disposed on the charge generation layer;

the charge transport layer is a surface layer of the electrophotographic photosensitive member, the charge transport layer has a matrix-domain structure comprising a matrix and a domain, the domain comprises a polyester resin A having:

a structural unit represented by the following Formula (A) and a structural unit represented by the following Formula (B), and the matrix comprises:

at least one resin selected from the group consisting of a polyester resin C having a structural unit represented by the following Formula (C) and a polycarbonate resin D having a structural unit represented by the following Formula (D) and a charge transport substance, wherein, the charging member comprises an electro-conductive substrate, and an electro-conductive elastic layer;

the electro-conductive elastic layer comprising a binder, and holding a bowl-shaped resin particle having an opening, so that at least a part of the bowl-shaped resin particle is exposed, and the charging member has a concavity derived from the opening of the bowl-shaped resin particle on the surface thereof, and a protrusion derived from an edge of the opening of the bowl-shaped resin particle on the surface thereof;

the protrusion on the surface of the charging member coming into contact with the electrophotographic photosensitive member:

(A)

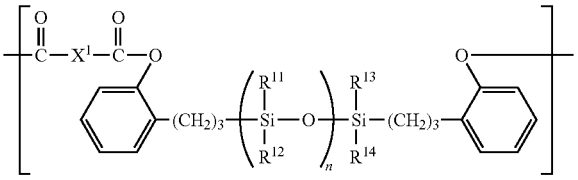

wherein, $X^1$ represents a m-phenylene group, a p-phenylene group, or a bivalent group having two p-phenylene groups bonded to an oxygen atom;

$R^{11}$ to $R^{14}$ each independently represent a methyl group, an ethyl group, or a phenyl group; and n represents the number of repetitions of a structure in brackets, an average value of n in the polyester resin A is 20 or more and 120 or less;

(B)

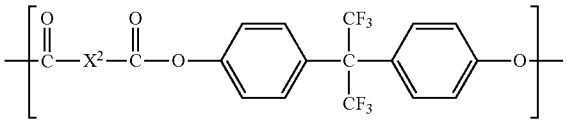

wherein, $X^2$ represents a m-phenylene group, a p-phenylene group, or a bivalent group having two p-phenylene groups bonded to an oxygen atom;

(C)

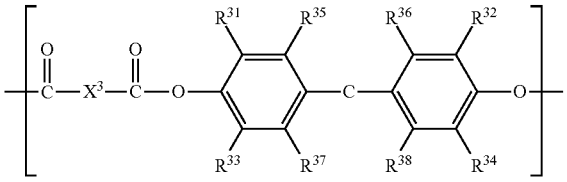

wherein, $R^{31}$ to $R^{38}$ each independently represent a hydrogen atom or a methyl group;

$X^3$ represents a m-phenylene group, a p-phenylene group, or a bivalent group having two p-phenylene groups bonded to an oxygen atom; and $Y^3$ represents a single bond, a methylene group, an ethylidene group, or a propylidene group;

(D)

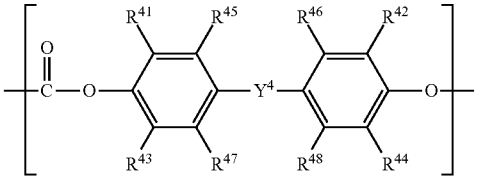

wherein, $R^{41}$ to $R^{48}$ each independently represent a hydrogen atom or a methyl group; and $Y^4$ represents a methylene group, an ethylidene group, a propylidene group, a phenylethylidene group, a cyclohexylidene group, or an oxygen atom.

2. The electrophotographic image forming apparatus according to claim 1, wherein the content of the structural unit represented by Formula (A) based on the total mass of the polyester resin A in the domain is 6% by mass or more and 40% by mass or less.

3. The electrophotographic image forming apparatus according to claim 1, wherein the content of the structural unit represented by Formula (B) based on the total mass of the polyester resin A in the domain is 60% by mass or more and 94% by mass or less.

4. The electrophotographic image forming apparatus according to claim 1, wherein the weight average molecular weight of the polyester resin A in the domain is 30,000 or more and 200,000 or less.

5. The electrophotographic image forming apparatus according to claim 1, wherein the number average particle size of the domain containing the polyester resin A is 100 nm or more and 1,000 nm or less.

6. The electrophotographic image forming apparatus according to claim 1, wherein the bowl-shaped resin particle to form the protrusion of the charging member is selected from the group consisting of an acrylonitrile resin, a vinyl chloride resin, a vinylidene chloride resin, a methacrylic acid resin, a styrene resin, an urethane resin, an amide resin, a methacrylonitrile resin, an acrylic acid resin, an acrylic acid ester resin, and a methacrylic acid ester resin.

7. The electrophotographic image forming apparatus according to claim 1, wherein the difference in height between the apex of the protrusion derived from the edge of the opening of the bowl-shaped resin particle and the bottom of the concavity derived from the opening of the bowl-shaped resin particle of the charging member is 5 μm or more and 100 μm or less.

8. The electrophotographic image forming apparatus according to claim 1, wherein the bowl-shaped resin particle of the charging member has a maximum diameter of 5 μm or more and 150 μm or less.

9. The electrophotographic image forming apparatus according to claim 1, wherein the bowl-shaped resin particle of the charging member has a ratio of the maximum diameter of the bowl-shaped resin particle to the minimum diameter of the opening ([maximum diameter]/[minimum diameter of opening]) of 1.1 or more and 4.0 or less.

10. The electrophotographic image forming apparatus according to claim 1, wherein the charging member has a ratio of the maximum diameter of the bowl-shaped resin particle to the difference in height between the apex of the protrusion derived from the edge of the opening of the bowl-shaped resin particle and the bottom of the concavity derived from the opening of the bowl-shaped resin particle ([maximum diameter]/[difference in height]) of 0.8 or more and 3.0 or less.

11. The electrophotographic image forming apparatus according to claim 1, wherein the bowl-shaped resin particle of the charging member has a shell thickness of 0.1 μm or more and 3 μm or less.

12. The electrophotographic image forming apparatus according to claim 1, wherein the content of the polyester resin A is 10% by mass or more and 40% by mass or less based on the total mass of all the resins in the charge transport layer.

13. The electrophotographic image forming apparatus according to claim 1, wherein the surface of the charging member has a ten-point average roughness (Rzjis) of 5 μm or more and 65 μm or less.

14. The electrophotographic image forming apparatus according to claim 1, wherein the charging member has an average interval of surface irregularities (Sm) of 20 μm or more and 200 μm or less.

* * * * *